US007319449B2

(12) United States Patent
Yamazaki et al.

(10) Patent No.: US 7,319,449 B2
(45) Date of Patent: Jan. 15, 2008

(54) IMAGE DISPLAY APPARATUS AND IMAGE DISPLAY METHOD

(75) Inventors: Katsunori Yamazaki, Matsumoto (JP); Takashi Kurumisawa, Shiujui (JP); Masanori Ishida, Kagoshima (JP)

(73) Assignee: Seiko Epson Corporation, Tokyo (JP)

( * ) Notice: Subject to any disclaimer, the term of this patent is extended or adjusted under 35 U.S.C. 154(b) by 676 days.

(21) Appl. No.: 10/872,376

(22) Filed: Jun. 22, 2004

(65) Prior Publication Data

US 2005/0017991 A1 Jan. 27, 2005

(30) Foreign Application Priority Data

Jul. 8, 2003 (JP) ..... 2003-193674

(51) Int. Cl.
*G09G 3/36* (2006.01)

(52) U.S. Cl. ..... 345/89; 345/87; 345/103; 345/204; 345/211; 345/690; 348/488; 348/490

(58) Field of Classification Search ..... 345/87, 345/89, 93–95, 211, 204, 690, 694–696, 60
See application file for complete search history.

(56) References Cited

U.S. PATENT DOCUMENTS 4,840,460 A 6/1989 Bernot et al.
5,748,276 A 5/1998 Uno et al.
5,847,688 A 12/1998 Ohi et al.
5,953,002 A * 9/1999 Hirai et al. ..... 345/204
6,064,361 A 5/2000 Akiyama
6,600,470 B1 7/2003 Tsuda
7,116,297 B2 * 10/2006 Koga et al. ..... 345/87
2003/0112257 A1 * 6/2003 Tamura ..... 345/690

FOREIGN PATENT DOCUMENTS

JP A-58-123587 7/1983

(Continued)

OTHER PUBLICATIONS

D. Castleberry, "Varistor-Controlled Liquid-Crystal Displays", *IEEE Transactions on Electron Devices,* vol. ED-26, No. 8, pp. 1123-1128, Aug. 1979.

(Continued)

*Primary Examiner*—Richard Hjerpe
*Assistant Examiner*—Jennifer T Nguyen
(74) *Attorney, Agent, or Firm*—Oliff & Berridge, PLC

(57) ABSTRACT

An aspect of the invention provides an image display apparatus that displays a plurality of input pixels which form input image data on a display section. In that case, each input pixel can be displayed in such a manner that display pixels having gradation values differing from the gradation value of the input pixel are combined. For example, when a pixel having a particular gradation value exists as an input pixel, the pixel is not displayed on the display section as it is being kept at the gradation value, but instead, is displayed in such a manner that a plurality of display pixels having gradation values differing from the gradation value of the input pixel are combined. As a result, the same gradation value is not displayed continuously. Therefore, this results in that the occurrence of crosstalk, which is problematical particularly in a TFD liquid-crystal panel, is reduced. Accordingly, the invention can remove crosstalk which is likely to occur in a TFD liquid-crystal panel by controlling the gradation level of a display image.

3 Claims, 26 Drawing Sheets

FOREIGN PATENT DOCUMENTS

| | | |
|---|---|---|
| JP | A-02-000012 | 1/1990 |
| JP | A-05-068221 | 3/1993 |
| JP | A-05-323283 | 12/1993 |
| JP | A-06-222740 | 8/1994 |
| JP | A-07-12144 | 5/1995 |
| JP | A-07-120724 | 5/1995 |
| JP | A-07-142013 | 6/1995 |
| JP | A-07-294881 | 11/1995 |
| JP | A-08-179278 | 7/1996 |
| JP | B2-2576951 | 11/1996 |
| JP | A-11-133918 | 5/1999 |
| JP | A-2000-147455 | 5/2000 |
| JP | A-2003-066922 | 3/2003 |

OTHER PUBLICATIONS

D. Baraff et al., "The Optimization of Metal-Insulator-Metal Nonlinear Devices for Use in Multiplexed Liquid Crystal Displays", *IEEE Transactions on Electron Devices*, vol. ED-28, No. 6, pp. 736-739, Jun. 1981.

K. Niwa et al., "LCTV Addressed by MIM Devices", *Sid 84 Digest*, pp. 304-307, 1984.

S. Togashi et al., "Matrix Liquid Crystal Display Controlled by Nonlinear Devices", *Technical Research Laboratory, Citizen Watch Co., Ltd.,* pp. 13-18, (1983).

* cited by examiner

Fig. 6

| GRADATION | GRADATION VALUE (ON PULSE WIDTH) |
|---|---|
| 0 | 0 |
| 1 | 13 |
| 2 | 26 |
| 3 | 36 |
| 4 | 46 |
| 5 | 58 |
| 6 | 70 |
| 7 | 82 |
| 8 | 94 |
| 9 | 103 |
| 10 | 112 |
| 11 | 134 |
| 12 | 156 |
| 13 | 206 |
| 14 | 234 |
| 15 | 255 |

<SWITCHING PROCESS FOR EACH FRAME (MODIFICATION 1)>

<SWITCHING PROCESS FOR EACH FRAME (MODIFICATION 2)>

<SWITCHING PROCESS FOR EACH FRAME (MODIFICATION 3)>

IMAGE DISPLAY APPARATUS AND IMAGE DISPLAY METHOD

BACKGROUND OF THE INVENTION

1. Field of Invention

The present invention relates to a driving circuit of a liquid-crystal panel, which is suitably used for displaying various kinds of information, a liquid-crystal panel, and an electronic device.

2. Description of Related Art

In so-called two-terminal device active matrix or TFD (Thin Film Diode) liquid-crystal panels, scanning electrodes are formed on one of two opposing substrates, and signal electrodes are formed on the other substrate, with a liquid-crystal layer being sealed in between the two substrates. Then, a device whose current-voltage characteristics is non-linear is interposed between the liquid-crystal layer and the scanning electrodes or between the liquid-crystal layer and the signal electrodes. An example of using a ceramic varistor as the non-linear two-terminal device can be seen in D. E. Casfleberry, IEEE, ED-26, 1979, P1123 to 1128, an example of using an amorphous silicon PN diode as the non-linear two-terminal device can be found in Togashi et al., Institute of Television Engineers of Japan (ITEJ) Technical Report ED782, IPD86-3, 1984, an example of using an MIM (Metal Insulator Metal) device as the non-linear two-terminal device can be found in D. R. Baraff et al., IEEE, ED-28, 1981, P736 to 739 and K. NiWa et al., SID84, DIGEST, 1984, P304 to 307, and other examples are known. Furthermore, technology for displaying half-tone by using a two-terminal device active matrix has been proposed, for example, in Japanese Patent No. 2576951.

SUMMARY OF THE INVENTION

In a TFD liquid-crystal panel, from a structural point of view, while one line (scanning line) of the display screen is being displayed, when the levels of the pixels contained in the one line are concentrated on a specific gradation, the electrical potentials of the signal-electrode lines change simultaneously. This change in the electrical potential is propagated to each pixel through scanning lines, causing horizontal crosstalk (hereinafter referred to simply as "crosstalk") to occur. Crosstalk refers to that, as described above, display levels differ on the display image in the lines where the pixel levels are concentrated on a specific gradation and in the lines where the pixel levels are not concentrated on a specific gradation regardless of the fact that the same gradation is being displayed.

An aspect of the invention has been made in view of the above points. An object of the invention is to remove crosstalk, such as that described above by controlling the gradation of a display image.

In one aspect of the invention, the image display apparatus can include a display section, and a display control device for displaying, on the display section, a plurality of input pixels which form input image data in such a manner that a plurality of display pixels having gradation values differing from the gradation values of the input pixels are combined.

The image display apparatus displays input image data formed of a plurality of input pixels on a display section. Here, the input pixels refer to pixels which form the input image data. At that time, the input pixel is displayed, on the display section, as a combination of display pixels having gradation values differing from the gradation value of the input pixel. The display pixels refer to pixels displayed on the display section. For example, when there is a pixel having a particular gradation value "a" as an input pixel, the pixel is not displayed on the display section as it is kept at the pixel value "a", but instead, a plurality of display pixels having gradation values "b", "c", etc., differing from the gradation value "a" are combined and displayed on the display section.

In this method, for example, even when pixels having the same gradation value "a" exist continuously in the input image data, the pixels of the same gradation value "a" are not continuously displayed, but instead, the display pixels of gradation values "b" and "c" can be displayed. Consequently, since the same gradation values are not continuously displayed, the occurrence of crosstalk resulting therefrom is reduced. At the same time, the advantage of the improved viewing angle can be obtained.

In one form of the image display apparatus, the plurality of display pixels can contain a first display pixel having a gradation value greater than the gradation value of the input pixel and a second display pixel having a gradation value less than the gradation value of the input pixel. In this form, by displaying a combination of display pixels having gradation values greater than and less than the gradation value of the input pixel, a display close to the gradation values of the input pixel becomes possible.

In one form of the image display apparatus, the plurality of display pixels are displayed so as to be adjacent to the direction of the scanning lines of the display section. As a result, since it is possible to prevent pixels of the same gradation values from continuing in the direction of the scanning lines of the display section, horizontal crosstalk in the TFD liquid-crystal panel can be effectively suppressed.

In one form of the image display apparatus, the display control device can also include a driving device for driving a pixel area of the display section on the basis of a driving pulse signal specified by the number of gradation control pulses corresponding to the gradation values of the display pixels, and a device for displaying the plurality of display pixels by controlling the gradation control pulses. In this form, by controlling the gradation control pulses, a display of display pixels of different gradation values is performed.

In one form of the image display apparatus, the input image data is moving-image data formed of a plurality of frame images, and the display control device can also include switching control device for switching and displaying, for each of the frame images, the first combination of the plurality of display pixels and the second combination of the plurality of display pixels, which differ from each other.

As described above, crosstalk can be reduced by displaying one input pixel as a plurality of display pixels, but the resolution of the image data is decreased. However, in the case of a moving image, if two types of different combinations are provided as combinations of a plurality of display pixels, and if a display is performed by switching the two combinations for each frame image, a decrease in resolution can be reduced from the viewpoint of human vision.

In one form of the image display apparatus, the display control device can include a driving device for driving a pixel area of the display section on the basis of a driving pulse signal specified by the number of gradation control pulses corresponding to the gradation values of the display pixels, and the switching control device displays a first combination of the plurality of display pixels and a second combination of the plurality of display pixels by controlling the gradation control pulses. In this form, the process for switching the combinations of the plurality of display images for each frame image can be performed by controlling the gradation control pulses. Therefore, by only inputting input image data to the display control device, a switched display is realized by a hardware process using driving means, and the like.

In one form of the image display apparatus, the switching control device can include a device for generating a first combination of the plurality of display pixels and a second combination of the plurality of display pixels on the basis of the input image data. In this form, images corresponding to a first combination and a second combination of a plurality of display pixels are generated in advance on the basis of the input image data, and by alternately displaying these images for each frame image, a switched display for each frame image is realized. Therefore, since an image to be switched and displayed is generated in advance by performing a software process on the input image data, in a display process on the display section, switching control can be realized by only alternately displaying these images.

In one form of the image display apparatus, the first combination of the plurality of display pixels is formed in such a manner that display pixels whose gradation values are greater than those of the input pixels and display pixels whose gradation values are less than those of the input pixels are alternately arranged in the direction of the scanning lines of the display section, and the second combination of the plurality of display pixels is formed in such a manner that display pixels whose gradation values are greater than those of the input pixels and display pixels whose gradation values are less than those of the input pixels are alternately arranged in sequences reverse to the first combination of the plurality of display pixels in the direction of the scanning lines of the display section. As described above, since two types of images, in which there is a difference in gradation values, that is, the light and dark patterns are reverse, can be switched and displayed for each frame, the resolution is improved.

In one form of the image display apparatus, the first combination of the plurality of display pixels and the second combination of the plurality of display pixels are formed in such a manner that subpixels whose gradation values are greater than a predetermined value and subpixels whose gradation values are less than the predetermined value are alternately arranged in units of subpixels which form each of the display pixels in the direction of the scanning lines of the display section. In this form, by causing the gradation values to differ in units of subpixels which form the display pixels, the advantage of the improved viewing angle can be improved.

In one form of the image display apparatus, the input image data is moving-image data formed of a plurality of frame images, and the display control device can include a switching control device for switching and displaying, for each of the frame images, one of the combinations of an odd number of different types of the plurality of display pixels. As described above, crosstalk can be reduced by displaying one input pixel as a combination of a plurality of display pixels, but the resolution of the image data is decreased. However, in the case of a moving image, if a plurality of types of different combinations are provided as combinations of a plurality of display pixels, and if the two combinations are switched and displayed for each frame image, a decrease in resolution can be reduced from the viewpoint of human vision. Here, by making the different combinations of display images to be switched and displayed to be an odd number of types, it is possible to prevent a voltage to be applied to the display pixels from containing DC components. A preferred example of the number of combinations of the display images is three types.

In one form of the image display apparatus, the display control device can include a driving device for driving a pixel area of the display section on the basis of a driving pulse signal specified by the number of gradation control pulses corresponding to the gradation values of the display pixels, and the switching control device can display the combination of the plurality of display pixels by controlling the gradation control pulses.

In this form, a process for switching and displaying the combinations of the plurality of display images for each frame image can be performed by controlling the gradation control pulses. Therefore, by only inputting input image data to the display control device, a switched display is realized by a hardware process using a driving device, etc.

In another aspect of the invention, the image display method for use in an image display apparatus having a display section includes an input step of inputting input image data formed of a plurality of input pixels; and a display step of displaying the plurality of input pixels on the display section in such a manner that a plurality of display pixels having gradation values differing from the gradation values of the input pixels are combined. According to this image display method, similarly to the image display apparatus, crosstalk can be reduced.

BRIEF DESCRIPTION OF THE DRAWINGS

The invention will be described with reference to the accompanying drawings, wherein like numerals reference like elements, and wherein:

FIG. 6 is a table showing the relationship between gradation values and the pulse width of an ON period;

DETAILED DESCRIPTION OF PREFERRED EMBODIMENTS

Preferred embodiments of the invention will now be described below with reference to the drawings.

Figures 1, 1A, 1B:
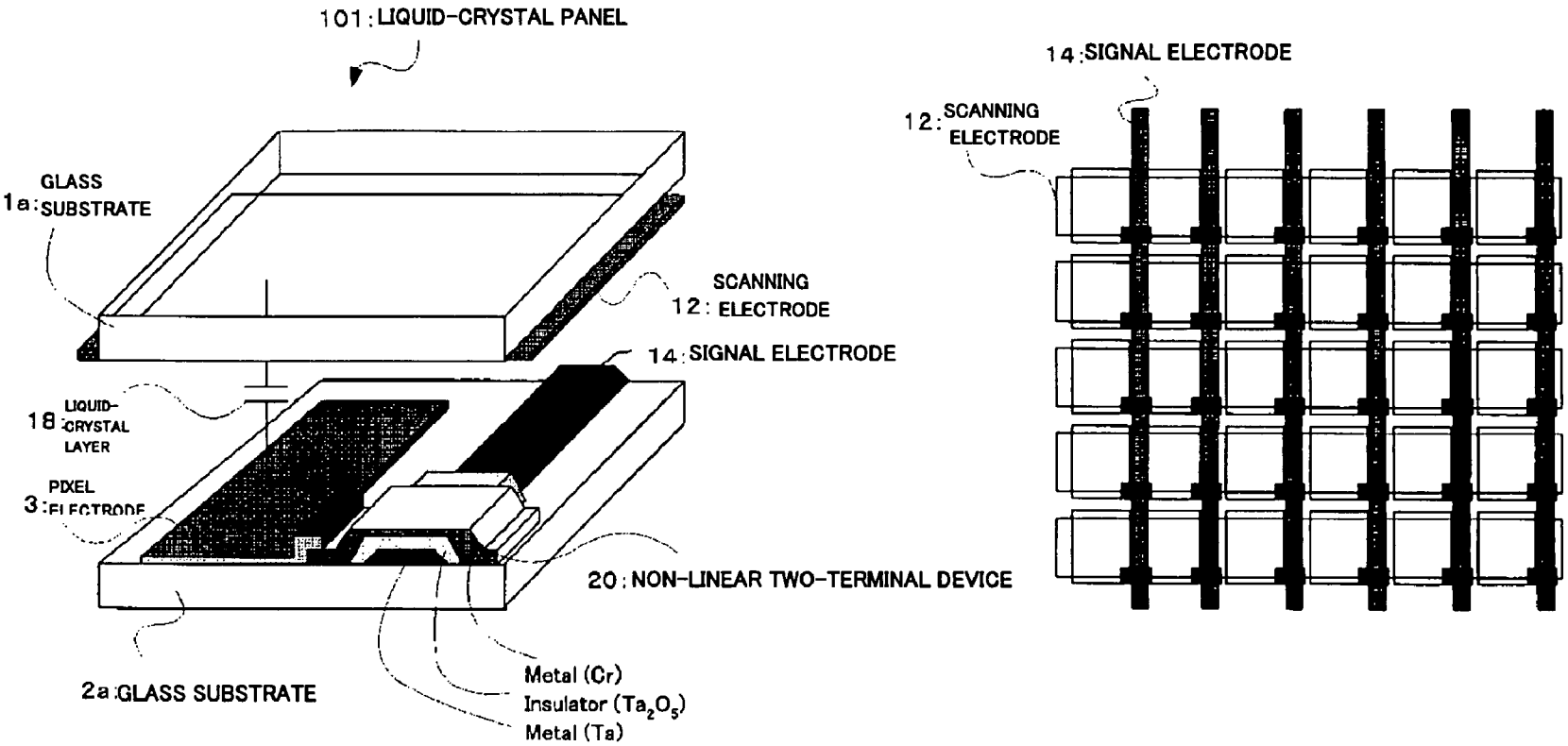
FIG. 1 shows the configuration of a liquid-crystal panel according to an embodiment of the present invention.

FIG. 1 shows the overall configuration of a liquid-crystal panel according to an exemplary embodiment of the invention. FIG. 1(*a*) shows the configuration of a portion corresponding to one pixel of a TFD liquid-crystal panel using an MIM (Metal Insulator Metal) device as a non-linear two-terminal device. As shown in this figure, a liquid-crystal panel 101 is formed in such a manner that a liquid-crystal layer 18 is interposed between two glass substrates 1*a* and 1*b* via a sealing member (not shown). Regarding the driving of the liquid crystal, of the two glass substrates, scanning electrodes 12 are formed on the glass substrate 1*a*, and signal electrodes 14 are formed on the other glass substrate 1*b*. Furthermore, a pixel electrode 3 corresponding to the display pixel is formed on the glass substrate 1*a*, and furthermore, a non-linear two-terminal device 20 whose current-voltage characteristics is non-linear is formed between the liquid-crystal layer 18 and the signal electrode 14. In this example, the scanning electrode 12 and the pixel electrode 3 are made of ITO (Indium Tin Oxide), and the non-linear two-terminal device is made of an MIM.

FIG. 1(*b*) shows the relationship between the scanning electrode 12 and the signal electrode 14. FIG. 1(*b*) shows the positional relationship between the scanning electrode 12 and the signal electrode 14 when a portion of the display area of the liquid-crystal panel 101 is observed from above. As shown in FIG. 1(*b*), the scanning electrode 12 can be formed in the form of a plurality of stripes. One scanning electrode 12 corresponds to one scanning line (one line), and one pixel is formed in the area where the scanning electrode 12 and the signal electrode 14 intersect each other.

Figure 2:
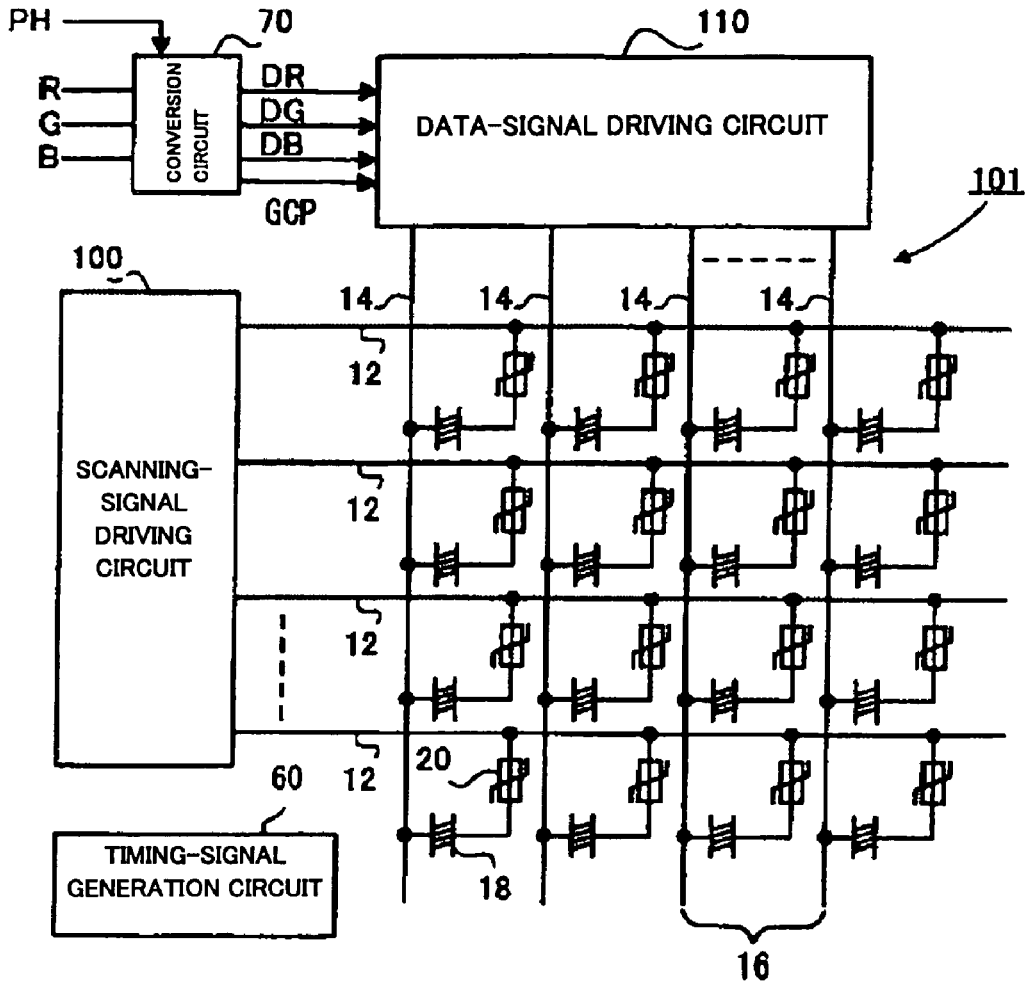
FIG. 2 shows an example of a liquid-crystal panel driving circuit.

FIG. 2 shows the configuration of the driving circuit of the liquid-crystal panel 101. In FIG. 2, the driving circuit of the liquid-crystal panel 101 includes a scanning-signal driving circuit 100, a data-signal driving circuit 110, a timing signal generation circuit 60, and a conversion circuit 70. The timing signal generation circuit 60 outputs various timing signals for driving the components shown in the figure.

Figure 3:
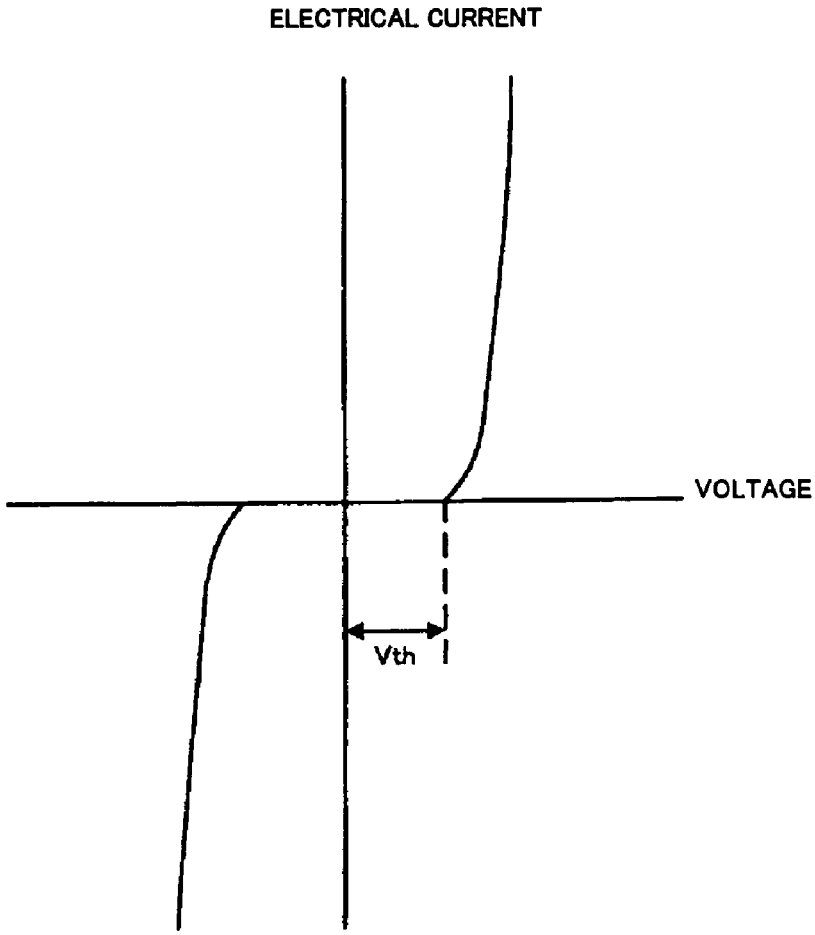
FIG. 3 is a characteristic view of a non-linear two-terminal device.

The liquid-crystal panel 101 can include a plurality of scanning electrodes 12, which are provided so as to extend in the row direction, and a plurality of signal electrodes 14, which are provided so as to extend in the column direction. In each of the intersections of the electrodes 12 and 14, the non-linear two-terminal device 20 and the liquid-crystal layer 18 are connected in series, thereby forming a pixel in each intersection. The above components constitute the liquid-crystal panel 101. The non-linear two-terminal device 20 has, for example, current-voltage characteristics shown in FIG. 3. In FIG. 3, electrical current hardly flows where the voltage is near zero volts, but when the absolute value of the voltage exceeds a threshold voltage Vth, the electrical current sharply increases as the voltage increases.

The scanning-signal driving circuit 100 applies a scanning potential VA to the scanning electrode 12, and the data-signal driving circuit 110 applies a signal potential VB to the signal electrode 14. The scanning potentials VA and VB will be described with reference to FIG. 4. First, a scanning potential VA shown in FIG. 4(*a*) is applied to the scanning electrode 12. The scanning electrodes 12 are selected in sequence every line-selection period T, and one of electrical potentials having a potential difference of ±Vsel with respect to a particular common potential VGND, that is, a voltage, is applied thereto. This voltage Vsel is called a selection voltage. Then, after the selection, one of voltages of ±Vhld is applied to the common potential VGND. Here, when the potential during the selection is VGND+Vsel, a potential of VGND+Vhld is applied, and when the potential during the selection is VGND−Vsel, a potential of VGND−Vhld is applied. This voltage Vhld is called a held voltage. The period in which the selection of all the scanning electrodes once in turn is completed is called a field period. In the next field period, the scanning electrodes are selected in sequence using a selection voltage with characteristics reverse to those of the previous field period.

Figure 4:
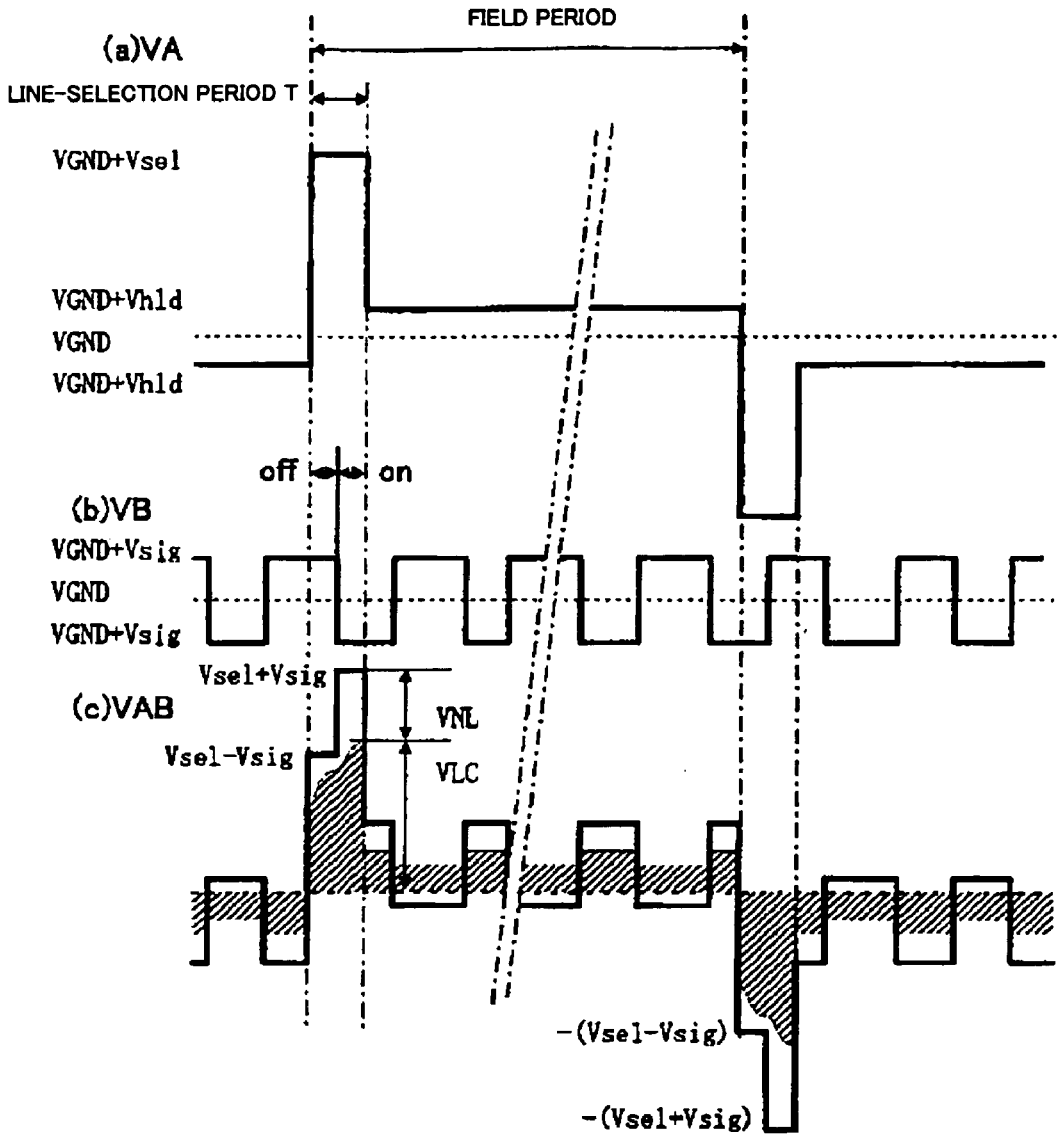
FIG. 4 is a waveform chart of each section in the liquid-crystal panel.

On the other hand, as shown in FIG. 4(*b*), one of electrical potentials having potential differences of ±Vsig with respect to the common potential VGND is applied to the signal electrode 14. Here, when the electrical potential to be applied to the scanning electrode selected during a particular selection period is VGND+Vsel, VGND−Vsig is used as an ON potential Von, and VGND+Vsig is used as an OFF potential Voff. Furthermore, when the electrical potential to be applied to the scanning electrode selected during a particular selection period is VGND−Vsel, VGND+Vsig is used as an ON potential Von, and VGND−Vsig is used as an OFF potential Voff.

In other words, the waveform within each line-selection period T of the signal potential VB is set according to the gradation of each pixel in a column corresponding to the signal electrode 14 of concern. First, the signal potential VB is divided into an ON period and an OFF period for each line-selection period T. In the ON period, the waveform is set to an ON potential Von, and in the OFF period, the waveform is set to an OFF potential Voff. That is, the signal potential VB is pulse width modulated according to the gradation value. Then, the higher (the darker in the normally white mode) the gradation to be given to the pixel, the larger the ratio at which the ON period is occupied is set.

Then, the inter-electrode voltage VAB between the scanning electrode 12 and the signal electrode 14 is indicated by the solid line in FIG. 4(*c*). It can be seen from the figure that the absolute value of the inter-electrode voltage VAB becomes higher in the period in which the pixel of concern is selected. Furthermore, a liquid-crystal layer voltage VLC to be applied to the liquid-crystal layer 18 is as indicated by hatching in FIG. 4(*c*). When the liquid-crystal layer voltage VLC changes, since the capacitance formed by the liquid-crystal layer 18 must be charged or discharged, the liquid-crystal layer voltage VLC changes in a transient-response manner with respect to the inter-electrode voltage VAB. In FIG. 4(*c*), a voltage VNL is a difference between the inter-electrode voltage VAB and the liquid-crystal layer voltage VLC, that is, a terminal voltage of the non-linear two-terminal device 20.

Figure 5A:
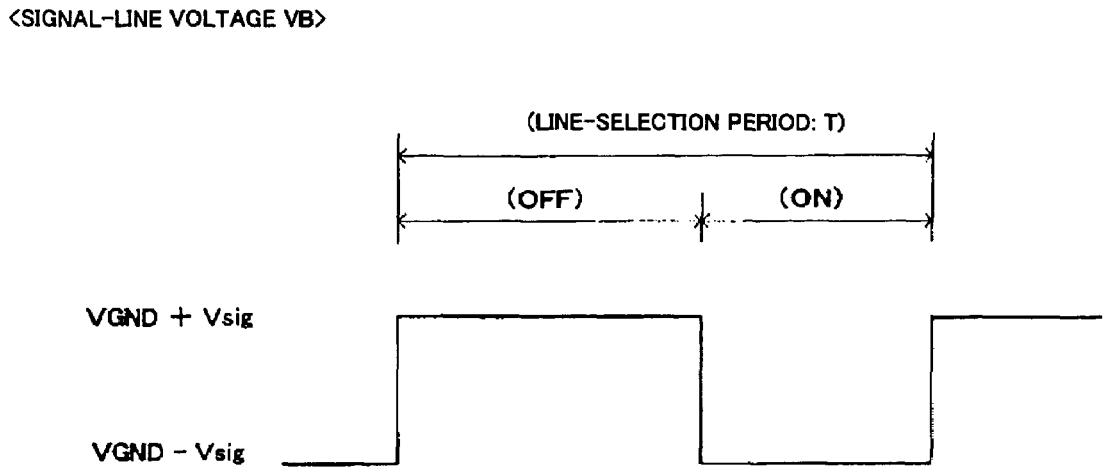
FIG. 5 is a waveform chart of a signal-line potential VB and a voltage VAB.
Figure 5B:
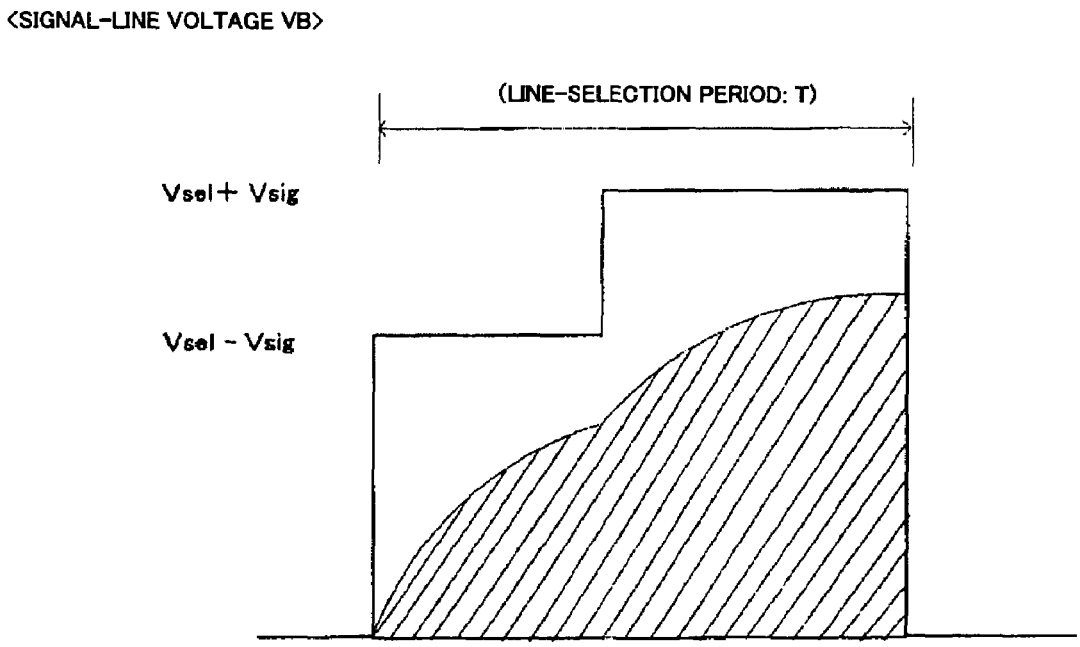

An example of the signal potential VB in this embodiment is shown in FIG. 5(*a*). In FIG. 5(*a*), the line-selection period T is formed of an ON period and an OFF period. Furthermore, since the scanning potential VA is as shown in FIG. 4(*a*), the inter-electrode voltage VAB and the liquid-crystal layer voltage VLC are as shown in FIG. 5(*b*).

The conversion circuit 70 converts color image signals R, G, and B, which are input externally, into data signals DR, DG, and DB. More specifically, when the color image signals R, G, and B are supplied, the conversion circuit 70 stores them in a line buffer (not shown), converts the color image signals R, G, and B into data signals DR, DG, and DB, and supplies them to the data-signal driving circuit 110. Here, the gradation value of each color of the color image signals R, G, and B is a value in the range of "0" to "15", and these values are converted into gradation values within the line-selection period T in accordance with the table of FIG. 6.

Furthermore, the conversion circuit 70 supplies a clock signal GCP (Gray Control Pulse) to the data-signal driving circuit 110. A method of generating the clock signal GCP will now be described. In the conversion circuit 70, a basic clock signal for dividing by 256 each line-selection period T is generated. Next, the basic clock signal is counted by an 8-bit (a maximum 255) counter, and when the count result reaches a predetermined value, one pulse of the clock signal GCP is output. This predetermined value corresponds to the gradation values (0, 13, 26, . . . 255) shown in FIG. 6. The count value at which one pulse of the clock signal GCP is output is set according to the gradation characteristics of the liquid-crystal panel 101 so that linearity is maintained.

In FIG. 6, if the gradation value is "0", the width of the ON period is also "0", and all the periods of the line-selection period of concern become OFF periods. Then, the higher the gradation, the larger the ratio at which the ON period is occupied (the number of basic clock signals). Then, at the gradation value 14, the ON period is set to "255", and all the periods of the line-selection period of concern become ON periods.

Figure 7:
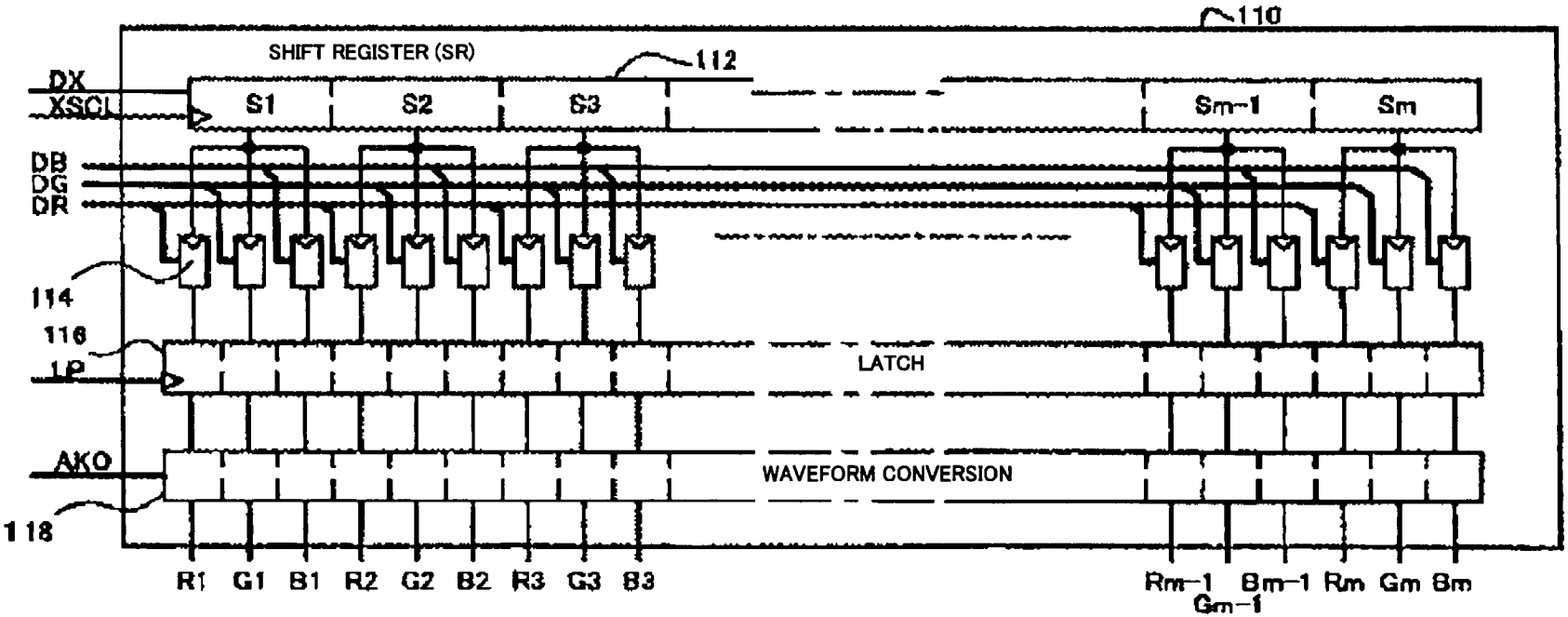
FIG. 7 is a circuit diagram of a data-signal driving circuit.
Figure 8:
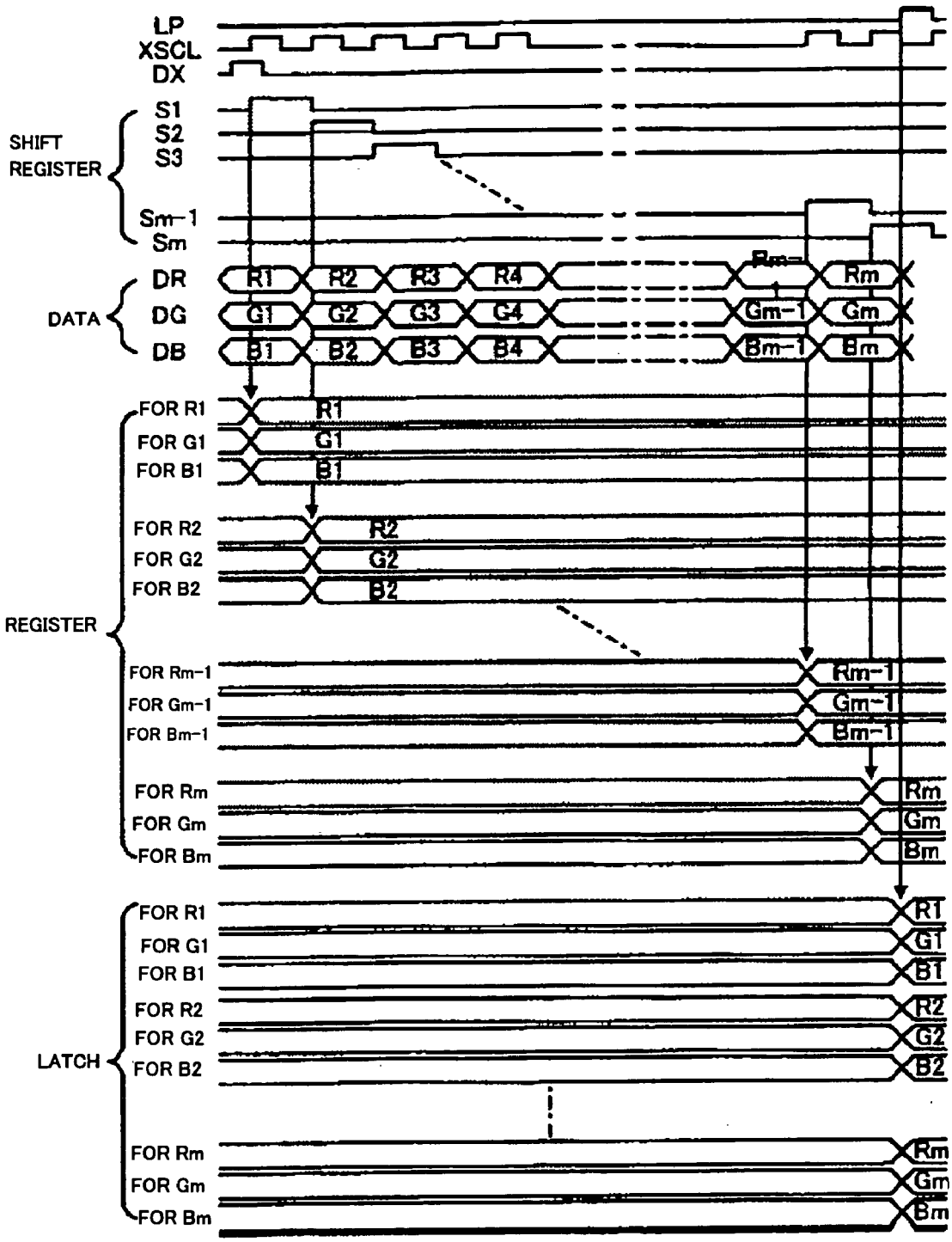
FIG. 8 is a timing chart when the liquid-crystal panel is driven.

The configuration of the data-signal driving circuit 110 will now be described in detail with reference to FIG. 7. A shift register 112 in the data-signal driving circuit 110 is a shift register of m/3 bits (m is the number of signal electrodes 14). Each time a pixel clock XSCL is supplied, the shift register 112 shifts the contents of each bit to the bit adjacent to the right. As shown in FIG. 8, the pixel clock XSCL is a signal that falls in synchronization with the timing at which the data signals DR, DG, and DB of each pixel are supplied. A pulse signal DX is supplied to the bit of the left end of the shift register 112. This pulse signal DX is a one-shot pulse signal which is generated when the data signals DR, DG, and DB of the line-selection period T are begun to be output from the conversion circuit 70. Therefore, signals S1 to Sm output from each bit of the shift register 112 are signals that exclusively reach an H level in sequence by an amount of time equal to the period of the pixel clock XSCL.

A register 114 latches the data signals DR, DG, and DB in units of three pixels in synchronization with the rise of each of the output signals S1 to Sm of the shift register 112. A latch circuit 116 simultaneously latches the data signals stored in the register 114 in synchronization with the rise of a latch pulse LP. A waveform conversion section 118 converts the latched data signal into the signal potential VB shown in FIG. 5(*a*) and applies it to the m signal electrodes 14. In other words, the output timing of this latch pulse LP becomes the starting timing of the line-selection period T.

Figure 9:
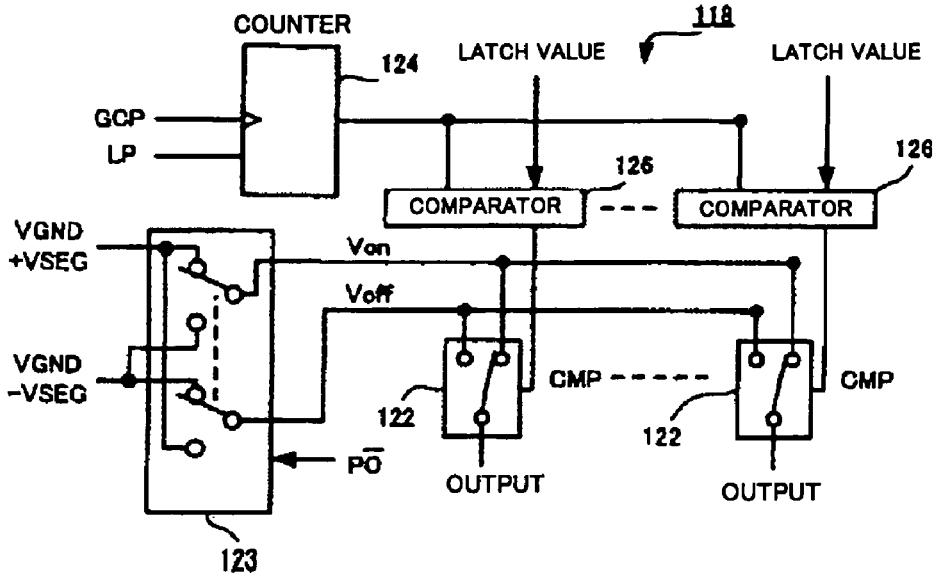
FIG. 9 is a circuit diagram of a waveform conversion circuit.

Next, an example of the configuration of the waveform conversion section 118 is shown in FIG. 9. In FIG. 9, the counter 124 is a counter that is commonly provided for all the signal electrodes 14. The count value thereof is reset to "0" at the rise time of the latch pulse LP, and the counter 124 counts the clock signal GCP. A comparator 126 compares the data signals DR, DG, and DB of each pixel, which are latched by the latch circuit 116, with the count value of the counter 124, outputs an H level when the count value is less than the values of the data signals, and outputs a comparison signal CMP when the count value is greater than or equal to the value of the data signal. Then, a switch 122 selects the ON potential Von when the corresponding comparison signal CMP is at an H level, selects the OFF potential Voff when it is at an L level, and outputs the selected potential as the signal potential VB.

Figure 10:
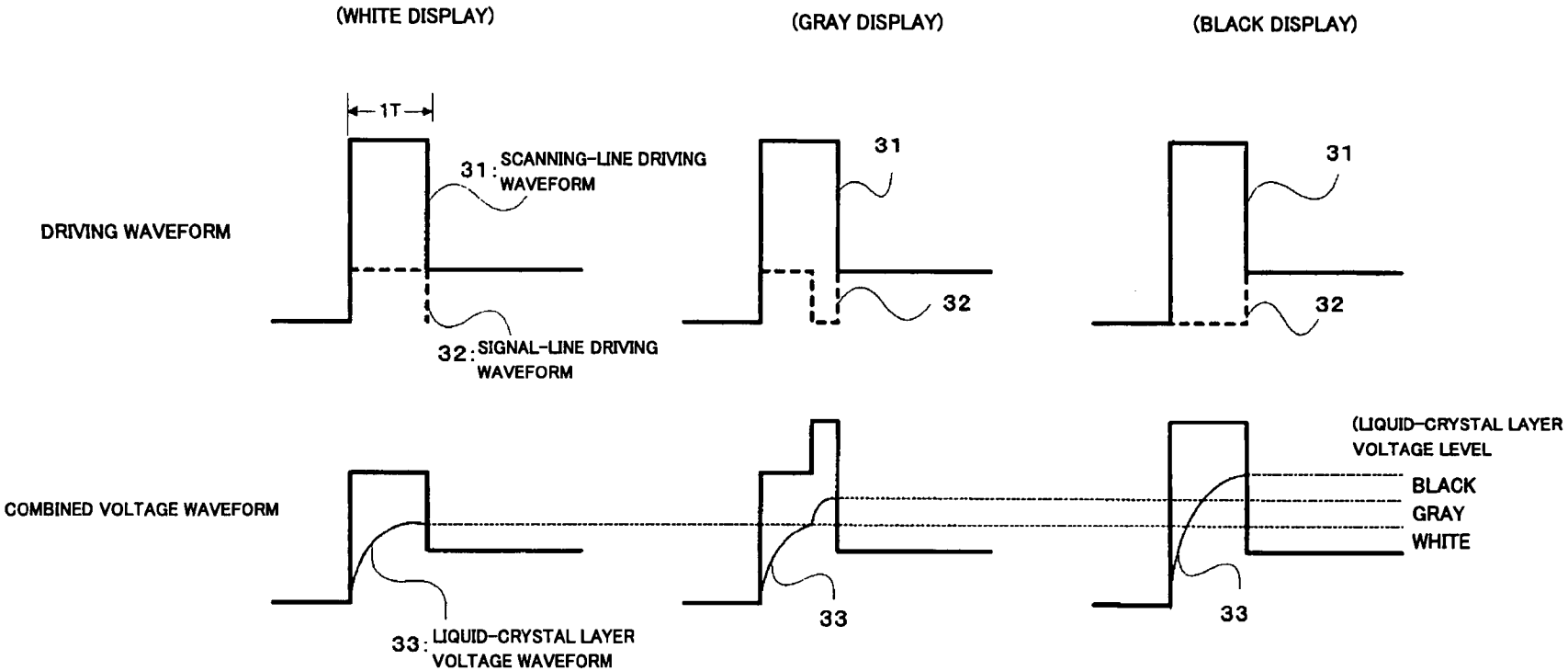
FIG. 10 is a waveform chart showing a driving waveform example of different gradation levels.

FIG. 10 shows a driving waveform in a gradation display in the exemplary TFD liquid-crystal panel 101. As described above, in the TFD liquid-crystal panel, a gradation display is performed by performing pulse width modulation on the driving voltage applied to the liquid-crystal layer 18. In the upper portions of FIG. 10, examples of driving waveforms for one line (IT) in the case of a white display, a gray display, and a black display are shown. In this embodiment, it is assumed that a normally white liquid-crystal panel is used.

A scanning-line driving waveform 31 is a pulse waveform applied to the scanning electrode 12, and specifies the operation potential VA. Furthermore, a signal-line driving waveform 32 is a pulse waveform applied to the signal electrode 14, and specifies the signal potential VB. As is understood from FIG. 1(*a*), the difference in the potentials of the scanning electrode 12 and the signal electrode 14, that is, the inter-electrode voltage, is applied to the liquid-crystal layer 18. In other words, a total voltage of the scanning-line driving waveform 31 and the signal-line driving waveform 32, that is, the inter-electrode voltage shown in the combined voltage waveform shown in the lower portion of FIG. 10, is applied to the liquid-crystal layer 18. In the lower portion of FIG. 10, the change in the voltage level of the actual liquid-crystal layer 18 (liquid-crystal layer voltage level) is shown as a liquid-crystal layer voltage waveform 33. In the liquid-crystal layer 18, since there is a delay from when the voltage is applied until the orientation of the liquid-crystal molecules is changed, a transient response in an amount corresponding to the delay occurs, and the liquid-crystal layer voltage waveform 33 shown in the lower portion of FIG. 10 is applied to the liquid-crystal layer 18. The gradation of the liquid-crystal display panel changes according to the liquid-crystal layer voltage level. Since the liquid-crystal panel of this embodiment is normally white, a white display is performed when the liquid-crystal layer voltage level is low, a black display is performed when the liquid-crystal layer voltage level is high, and a gray display (half-tone display) is made when the liquid-crystal layer voltage level is intermediate between them.

As is understood from the waveform in the upper portion of FIG. 10, the half-tone level during the gray display (half-tone display) is controlled by the pulse width of the signal-line driving waveform 32. This signal-line driving waveform 32 is determined by the above-described GCP. Therefore, by changing the GCP, the pulse width of the signal-line driving waveform 32 is changed, thereby making it possible to change the half-tone level.

Figure 11:
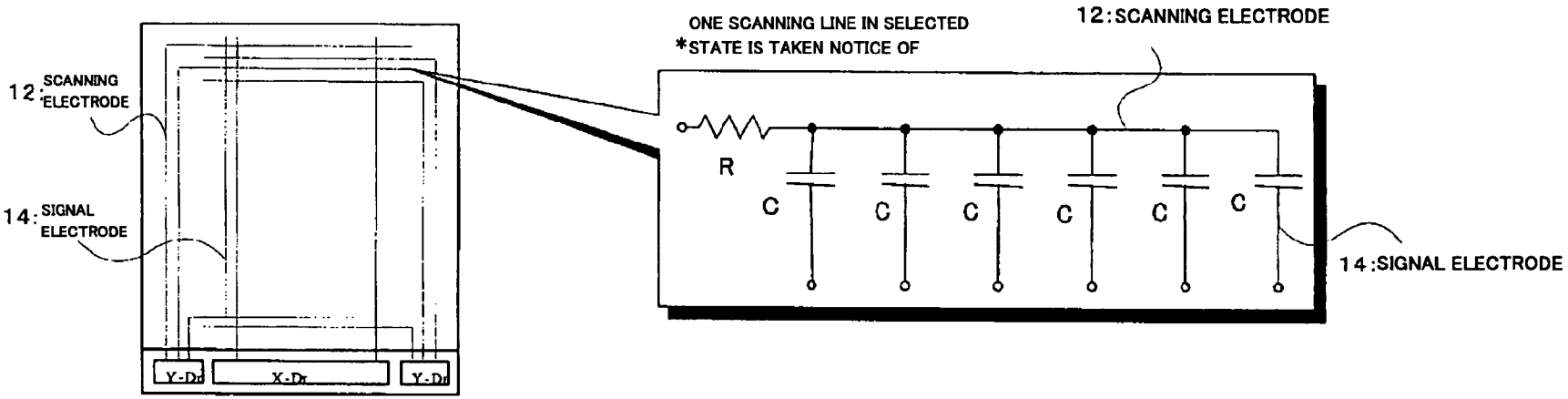
FIG. 11 shows an equivalent circuit for one line of the liquid-crystal panel.

Next, crosstalk will now be described with reference to FIGS. 11 and 12. FIG. 11 shows an equivalent circuit of one scanning line of the liquid-crystal panel 101. The liquid-crystal layer 18 between the scanning electrode 12 and the signal electrode 14 functions as a capacitance C between the two electrodes. That is, in electrical terms, with regard to one specific line, the capacitances C for the number of pixels of one line are connected in parallel between the scanning electrode 12 and the signal electrode 14. Furthermore, a resistor portion R resulting from the length of the extension of the scanning electrode 12 is connected in series to the parallel connection of the capacitances C. This causes a transient response to occur in the pulse waveform applied to the liquid-crystal layer 18.

Figure 12:
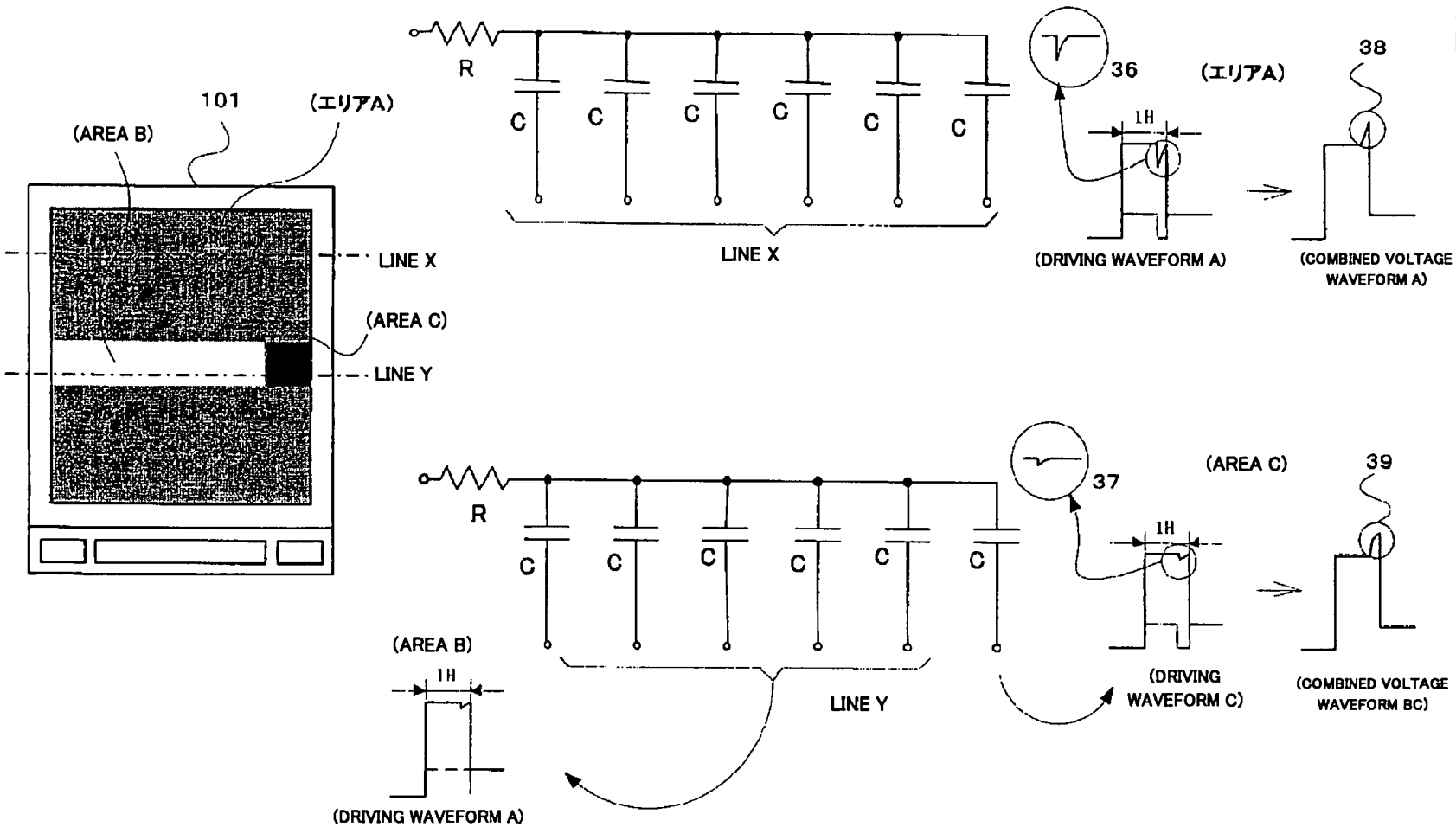
FIG. 12 illustrates crosstalk generation principles.

FIG. 12 shows an equivalent circuit in specific lines X and Y of the liquid-crystal panel 101, as well as a driving waveform to be applied thereto and a combined voltage waveform. In FIG. 12, a state in which crosstalk has occurred in the liquid-crystal panel 101 is shown. A scanning-line voltage and a signal-line voltage are applied to the liquid-crystal panel 101 so that an area A and an area C reach the same gray level and an area B reaches a white level. However, in practice, due to the occurrence of crosstalk, in the area A and the area C, which should be at the same gradation level, the gray level on the display image differs.

More specifically, the equivalent circuit of the line X is shown in the upper portion of FIG. 12. In the area A, since the display is performed at the same gradation level, each pixel of the line X is displayed at the same gradation level. In the driving waveform A at that time, a spike-shaped waveform (for the sake of convenience of description, hereinafter referred to as a spike waveform) 36 occurs due to the resistor portion R and the capacitance C as shown in this figure, and a spike waveform 38 corresponding thereto occurs also in the combined voltage waveform A. The combined voltage waveform allows the gray level of the display pixels in the line X to be determined.

On the other hand, with regard to the line Y, a driving waveform B in the lower left is applied in the area B, and a driving waveform C in the lower right is applied in the area C. Therefore, when compared to the case of the line X, the applied voltage is small in the area B where a white display is performed. As a result, the level of a spike waveform 37 which occurs in the driving waveform C becomes smaller than that of a spike waveform 36 of a driving waveform A. Therefore, a spike waveform 39 in the combined voltage waveform BC of the line Y is larger than the spike waveform 38 in the combined voltage waveform A of the line X. As a result, in the area C, the liquid-crystal layer voltage level applied to the liquid-crystal layer 18 is higher than that in the area A, and the display image becomes gray closer to black. That is, the gradations of the area C and the area A where the same gray level was tried to be displayed become different. The foregoing is the principles in which crosstalk occurs.

A description will now be given of a method of reducing crosstalk. As described above, crosstalk is likely to occur because a spike waveform becomes large as a result of the gradation of the pixels of a particular line being concentrated on one gradation. In the above-described example of the lines X and Y, since the same gray gradation is concentrated in the area A, a gray gradation, which is darker than the original gradation level is displayed. In comparison to this, in the area B, since the gradation is concentrated at the white level, this causes the signal-line voltage of the line of concern to be distributed to a waveform change of the white level and a waveform change for displaying the same gray as that of the area A. For this reason, in the area C, since the change in the electrical potential due to the spike waveform is reduced, a gray display, which is darker than that of the area A, is performed, and crosstalk has occurred. Therefore, basically, by performing gradation control so that the gradation level of the pixels in a particular line are not concentrated on one gradation, crosstalk can be reduced.

Figures 13A, 13B:
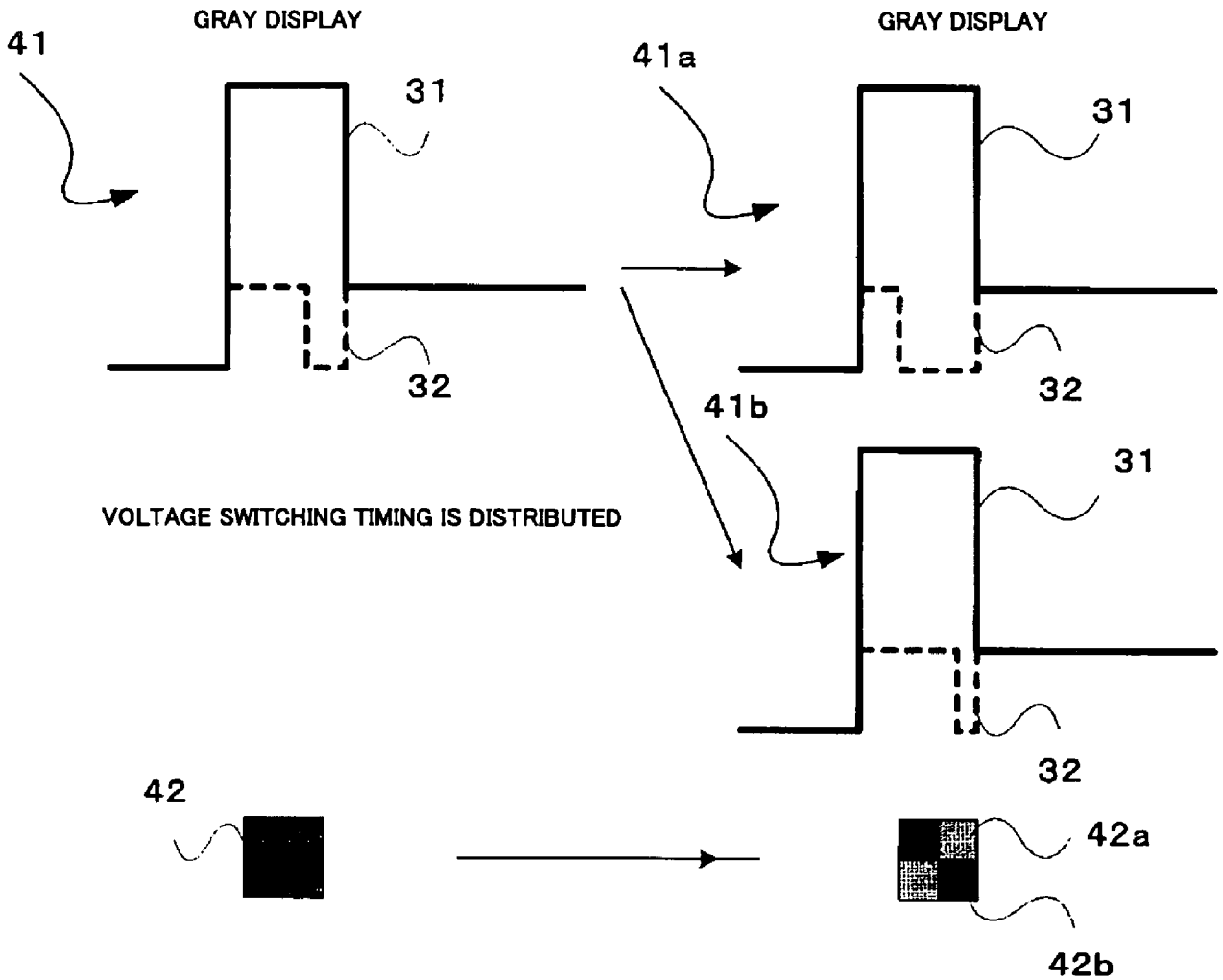
FIG. 13 illustrates a crosstalk reduction method.

FIG. 13 schematically shows a method of preventing such gradation concentration for the purpose of reducing crosstalk. When a pixel 42 of a gradation level shown in the lower portion of FIG. 13(*a*) is displayed by a driving waveform 41 shown in the upper portion of FIG. 13(*a*), in the invention, gradations of two different gradation levels are used as shown in FIG. 13(*b*). In other words, the gradation level is displayed using a combination of two pixels, that is, a pixel 42*a* at a gradation level brighter than the gradation level of the original pixel 42 and a pixel 42*b* at a gradation level darker than that.

For the driving waveform, as shown in FIG. 13(*b*), the liquid-crystal layer 18 is driven by a driving waveform 41*a* for which the ON period of the signal-line driving waveform 32 is longer and a driving waveform 41*b* for which the ON period of the signal-line driving waveform 32 is shorter. As a result, it is possible to prevent the gradation level from being concentrated in the same line, thus making it possible to reduce crosstalk.

In this case, it is preferable that, for example, the gradation value of the pixel 42*a* be determined to be less than the gradation value of the pixel 42 and the gradation value of the pixel 42*b* be determined to be greater than the gradation value of the pixel 42. As a result of the above, the combination of the pixels 42*a* and 42*b*, shown in FIG. 13(*b*), is recognized as being equal to the gradation of the pixel 42 as a whole. In a more specific example, the following is preferable:

(the gradation value of the pixel 42)={(the gradation value of the pixel 42*a*)+(the gradation value of the pixel 42*b*)}/2.

The gradation value in this case indicates the gradation value in terms of the vision characteristics of a human being, and is not a gradation value in terms of the optical characteristics. This is because the vision characteristics of a human being are not linear, and usually has characteristics of $\gamma=2.2$ with respect to the optical luminance value.

Figure 14:
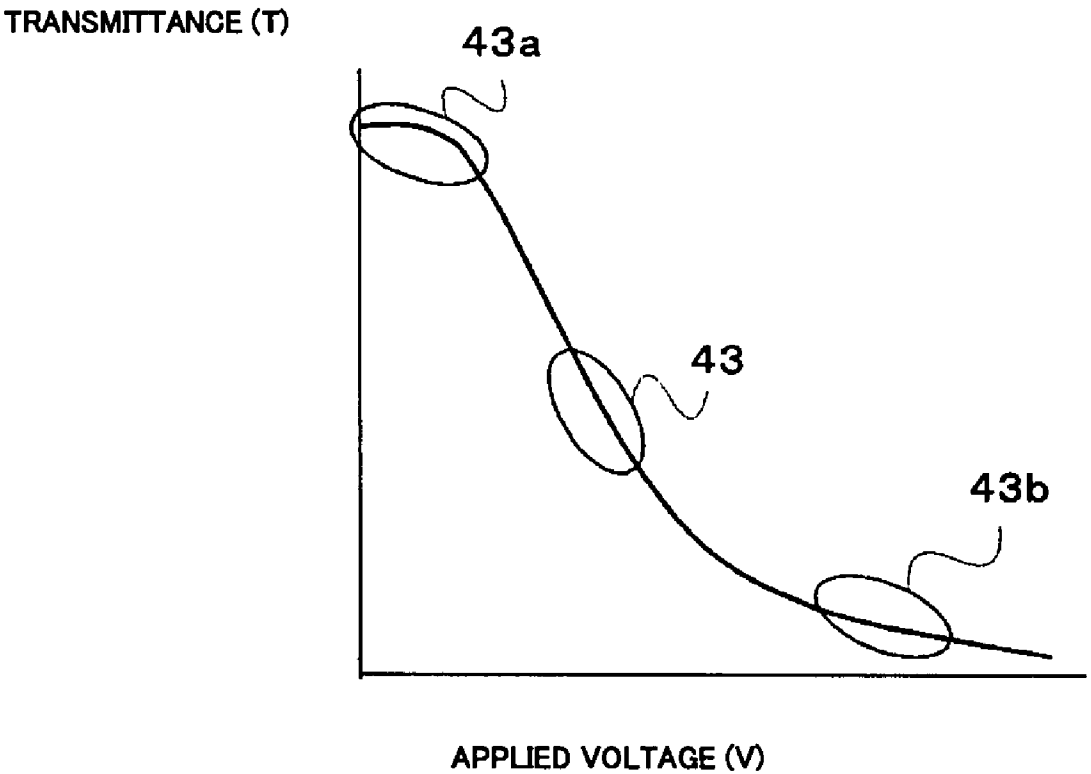
FIG. 14 is a graph showing the relationship between an applied voltage of a liquid-crystal layer and the transmittance.

As a result of displaying the original pixel by using the combination of pixels of different gradation levels in this manner, crosstalk can be reduced in terms of the vision of a human being. FIG. 14 shows the relationship between an applied voltage of a liquid-crystal layer and the transmittance. The applied voltage and the transmittance have a non-linear relationship shown in the figure. For example, if the gradation level of the pixel 42 shown in FIG. 13 is near an area 43 of FIG. 14, the pixel 42*a* at a gradation level brighter than that is near an area 43*a* in FIG. 14, and the pixel 42*b* at a darker gradation level is near an area 43*b* in FIG. 14. Near the area 43, the inclination of the graph is large, and the change in the transmittance of the liquid-crystal layer with respect to the change in the applied voltage, that is, the change in the gradation level, is large. In comparison with this, in the areas 43*a* and 43*b*, the inclination of the graph is small, and the change in the transmittance of the liquid-crystal layer with respect to the change in the applied voltage, that is, the change in the gradation level, is small. Therefore, when the applied voltage varies due to the influence of crosstalk, even in the case of the same amount of variation of voltage, the change of the gradation level of the pixel 42 corresponding to the area 43 is large, but the change of the gradation level of the pixels 42*a* and 42*b* corresponding to the areas 43*a* and 43*b* is small. Therefore, as shown in FIG. 13(*b*), by displaying the pixel of a specific gradation level as the combination of the pixel

43*a* having a brighter gradation level and the pixel 43*b* having a darker gradation level, the variation of the gradation level, which is recognized in the display pixel, is small even when the driving voltage of each pixel varies slightly. In this manner, the advantage of reducing crosstalk can be obtained from the viewpoint of the characteristics of the liquid crystal.

Figure 15A:
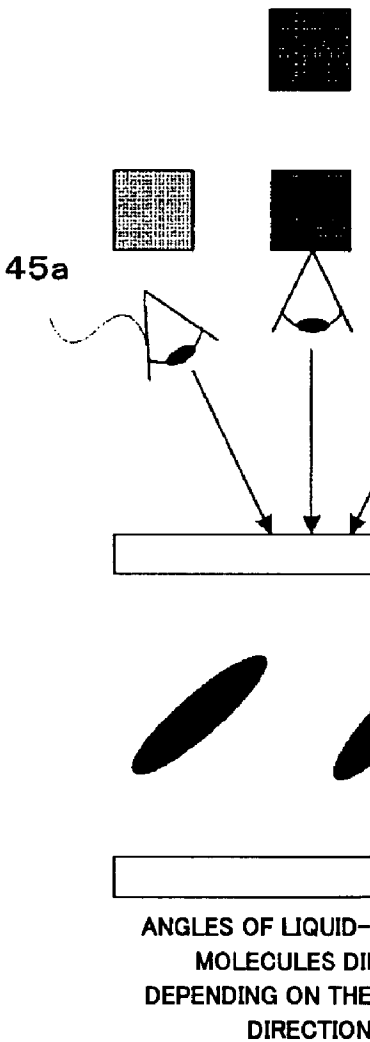
FIG. 15 illustrates the viewing angle improvement advantage according to this method.
Figure 15B:
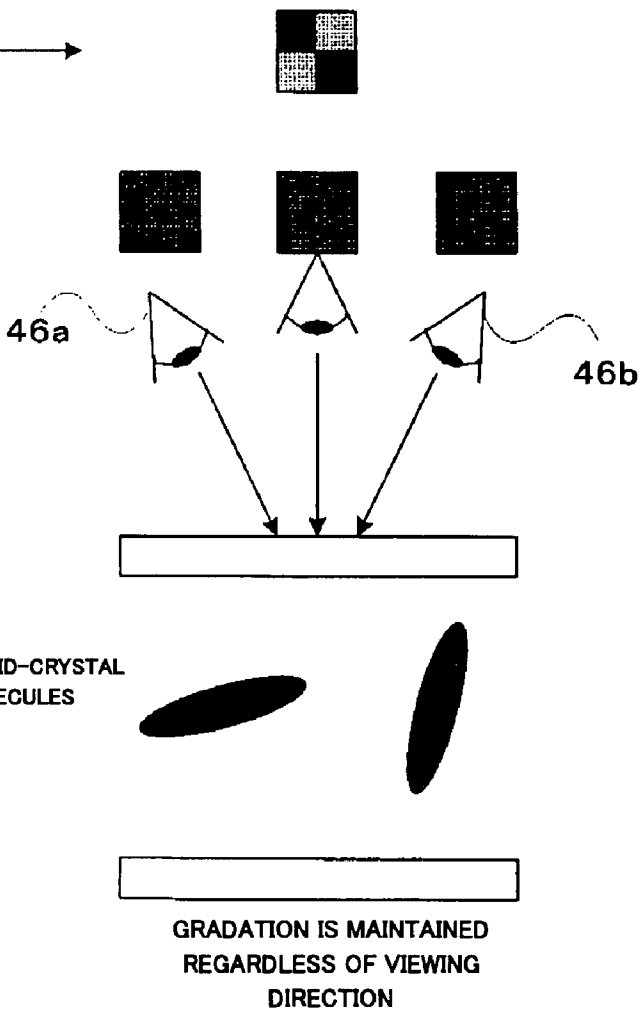
Figure 16A:
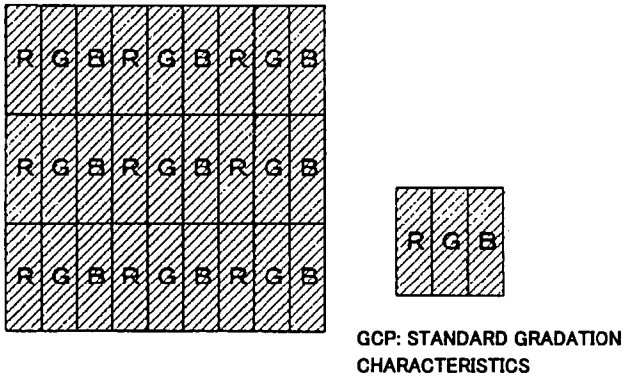
FIG. 16 shows an example of frame switching control.
Figure 16B:
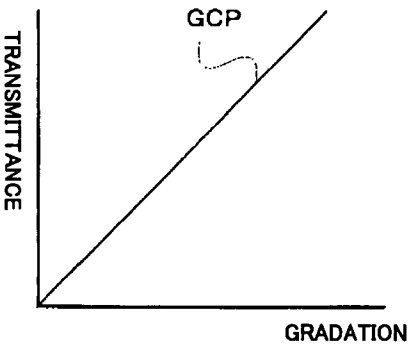
Figure 16C:
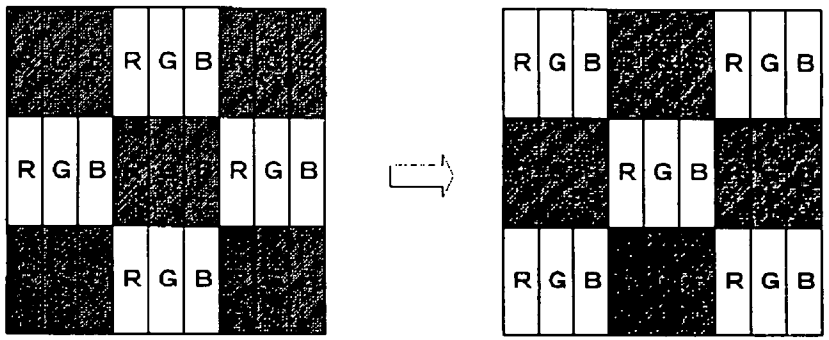
Figure 16D:
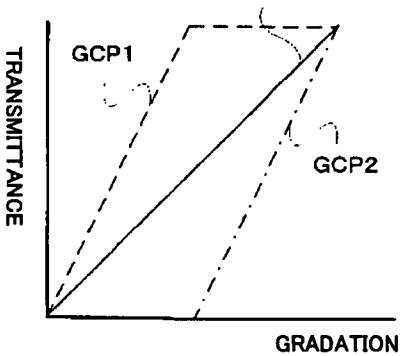

Furthermore, by displaying the pixel at a particular gradation level as a combination of pixels at gradation levels higher and lower than that level in this manner, the viewing angle improvement advantage is obtained in addition to the crosstalk reduction advantage. The viewing angle improvement advantage is schematically shown in FIG. 15. The liquid-crystal mode is described as a normally white mode. In the normally white mode, when no electric field is applied (the liquid crystal lies down), a white display is performed, and when an electric field is applied (the liquid crystal rises), a black display is performed.

FIG. 15(*a*) shows an example of a case in which a particular gradation level is displayed by one pixel. In this case, the liquid-crystal molecules inside the liquid-crystal layer are oriented in one direction as shown in the figure. Consequently, the angle of the liquid-crystal molecules differs depending on the observer's viewing direction. In the liquid-crystal panel, since light and dark are displayed by light that is transmitted through or shielded by the liquid-crystal molecules, the pixels is seen dark when viewed from an observer 45*b* of FIG. 15(*a*), and the pixels are seen bright when viewed from an observer 45*a*. That is, the viewing angle dependence becomes greater in the display of the liquid-crystal panel.

In comparison, FIG. 15(*b*) shows a case in which a pixel of a particular gradation level is displayed as the combination of pixels of two different gradation levels of a bright gradation level and a dark gradation level in accordance with the above-described crosstalk reduction method. As is understood from the figure, in this case, since the orientation of the liquid-crystal molecules within the liquid-crystal layer differs for each of the two gradation levels, the pixel is recognized at the equal gradation level regardless of the observer's viewing direction. That is, the pixel is recognized at the same gradation level at the positions of the observers 46*a* and 46*ab*. Thus, the viewing angle dependence is reduced.

In this manner, by displaying a pixel of a particular gradation level as a combination of pixels of different gradation levels by using the crosstalk reduction method in accordance with the invention, in addition to the crosstalk reduction advantage, the viewing angle improvement advantage can also be obtained. The crosstalk reduction method can be applied to both cases where image data to be displayed is a still image and a moving image.

As described above, in the crosstalk reduction method in accordance with the invention, a pixel of a particular gradation level is displayed as pixels of two different gradation levels. As is understood from FIG. 13, etc., since one gradation level is displayed by a combination of four adjacent pixels, the resolution of the image is decreased. Accordingly, by switching the change in the gradation level for each frame, a decrease in the resolution can be prevented. Such a technique will now be described.

FIG. 16 shows an example of gradation control of an area containing a plurality of pixels. FIG. 16(*b*) shows standard gradation characteristics, that is, gradation characteristics in a case where the above-described gradation control for reducing crosstalk is not applied. FIG. 16(*a*) shows an example of a display of a plurality of pixels in that case. All the pixels are displayed by the gradation characteristics shown in FIG. 16(*b*). The gradation characteristics can be changed by changing the GCP for determining the signal-line driving waveform 32 of the liquid-crystal layer in the manner described above. FIG. 16(*b*) shows gradation characteristics obtained by the GCP corresponding to the standard gradation characteristics.

On the other hand, in the gradation control for reducing crosstalk in accordance with the invention, as shown in FIG. 16(*c*), adjacent pixels are displayed by the combination of pixels at a bright gradation level and pixels at a dark gradation level. In this case, in order to prevent a decrease in the resolution, images which are formed different for each frame are alternately displayed. In the example of FIG. 16(*c*), a bright pixel is obtained by using GCP1 corresponding to bright gradation characteristics, and a dark pixel is obtained by using GCP2 corresponding to dark gradation characteristics. An example of gradation characteristics corresponding to the GCP1 and the GCP2 in this case is shown in FIG. 16(*d*). In other words, by making a display in such a manner that the GCP1 corresponding to bright gradation characteristics and the GCP2 corresponding to dark gradation characteristics are provided and these are switched for each frame, images of different structures are alternately displayed as shown in FIG. 16(*c*), and thus a decrease in the resolution can be suppressed. Since adjacent pixels are alternately displayed in accordance with the gradation characteristics corresponding to the GCP1 and the gradation characteristics corresponding to the GCP2, both of which are shown by the broken line in FIG. 16(*d*), it is recognized in terms of the vision of a human being that the pixels are displayed in accordance with the GCP indicated by the solid line. Therefore, by displaying an image of a pattern different for each frame, in addition to the reduction of crosstalk, it becomes possible to suppress a decrease in the resolution, which is recognized by a human being.

A description will now be given of advantages obtained by switching two different image patterns for each frame in this manner (hereinafter referred to as frame switching control). Basically, when the resolution is decreased due to gradation control for reducing crosstalk in accordance with the invention, the amount of decrease in the resolution can be compensated for by applying frame switching control. The secondary advantages involved therewith include the following items.

First, there is the advantage that variations in display resulting from variations in characteristics of the non-linear two-terminal devices shown in FIG. 1 and variations in electrical connection state between devices can be absorbed. If there are variations in characteristics of the non-linear two-terminal devices used in the liquid-crystal panel 101 and variations in electrical connection state between these devices, this may result in that, even when the same driving voltage is applied, the gradation level subtly differs for each pixel, and uneven and stain portions can occur in the display image. However, by applying the above-described frame switching control, such defects in display can be made inconspicuous.

Furthermore, the advantage of reducing the blur of the edge when a moving image is displayed on the liquid-crystal panel can be expected. More specifically, in a case where, for example, a moving image, which contains a rectangular window and such that the window moves within the display screen, is to be displayed on the liquid-crystal panel, the defect such that the edge of the window is displayed in such a manner as to linger as the window moves can occur. With respect to this, a report, in which making the change in the gradation of the display image sharp is effective, has been made (see, for example, Kazuo Sekiya et al., "Late-News Paper: Eye-Trace Integration Effect on The Perception of Moving Pictures and A New Possibility for Reducing Blur on Hold-Type Displays, 930 SID 02 DIGEST). It is considered that the above-described frame switching control allows equivalent improvements to be obtained.

Furthermore, the liquid-crystal panel has the properties such that the response of the change in the orientation of the liquid crystals in response to the application of a driving voltage is delayed. In order to reduce this delay, a technique of heightening the initial level of the driving voltage has been proposed (this technique is called a "Level Adaptive Overdrive"). However, instead, it is considered that, by applying the frame switching control, it is made difficult to sense the delay of the response of the liquid crystal by using the vision characteristics of a human being.

An exemplary embodiment of a configuration for realizing the above-described frame switching control will now be described.

Figure 17:
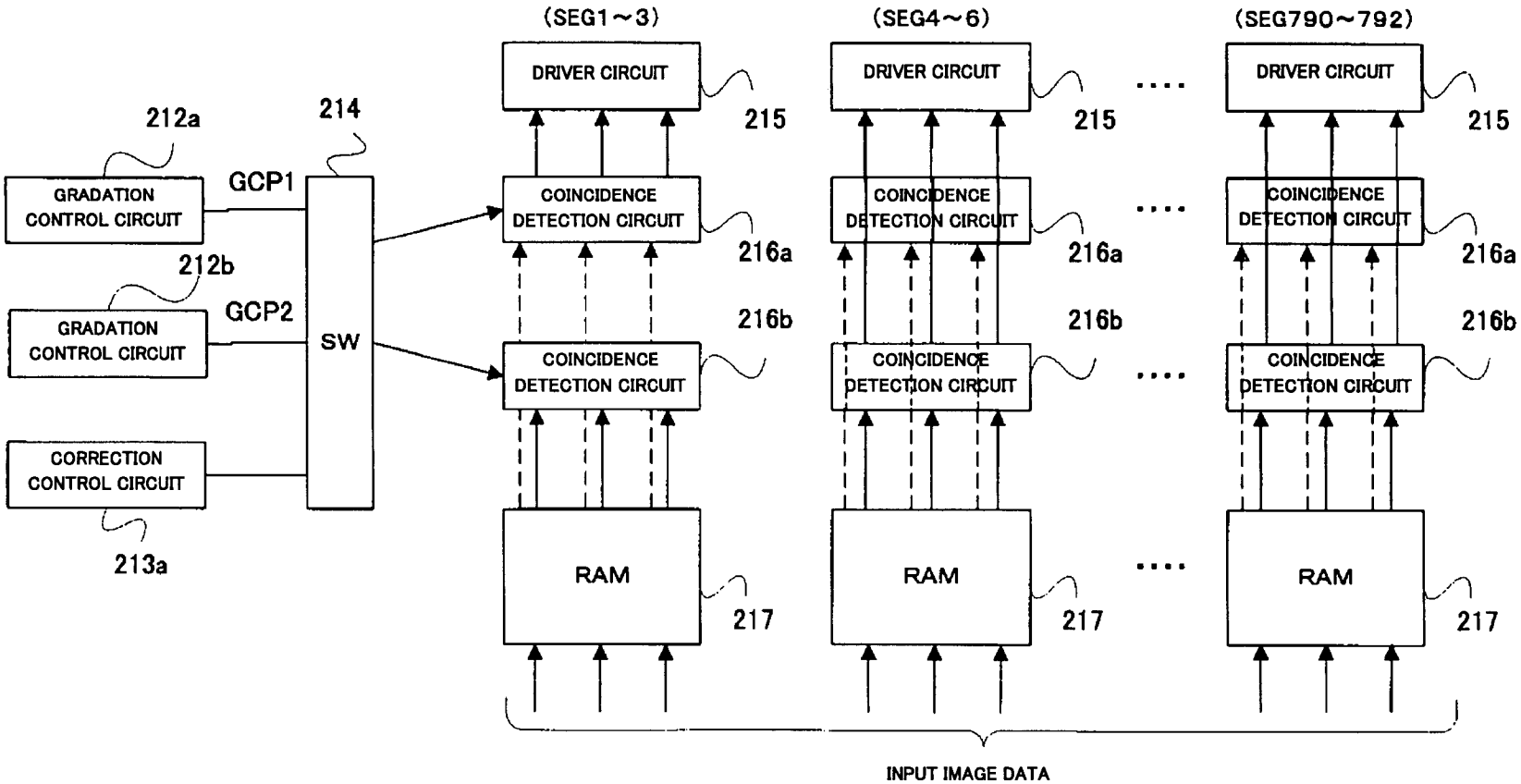
FIG. 17 shows an example of a configuration for frame switching control.

A first embodiment is described first with reference to FIG. 17. The first embodiment is configured to generate two types of GCPs within a driver IC for driving the liquid-crystal panel 101, an example of which being shown in FIG. 17. FIG. 17 shows the configuration of part of the driver IC. The driver IC includes gradation control circuits 212*a* and 212*b*, a correction control circuit 213*a*, a switch 214, a driver circuit 215, coincidence detection circuits 216*a* and 216*b*, a RAM 217, etc. In FIG. 17, the RAM 217, the coincidence detection circuits 216*a* and 216*b*, and the driver circuit 215 are shown by being divided for each block for one pixel (formed of three subpixels of RGB, each corresponding to one segment SEG). Therefore, the driver circuit 215, the coincidence detection circuits 216*a* and 216*b*, and the RAM 217 can be formed as one unit in practice.

In FIG. 17, image data, which is input externally, is temporarily stored in the RAM 217. The image data which is temporarily stored in the RAM 217 is supplied to the coincidence detection circuits 216*a* and 216*b*. On the other hand, the gradation control circuit 212*a* generates GCP 1 corresponding to bright gradation characteristics and supplies it to the switch SW 214 in the above-described manner.

Furthermore, the gradation control circuit 212*b* generates GCP2 corresponding to dark gradation characteristics and supplies it to the switch SW 214. Based on a switching signal from the correction control circuit 213*a*, the switch 214 supplies GCP1 to the coincidence detection circuit 216*a* with regard to the n-th line and supplies GCP2 to the coincidence detection circuit 216*b* with regard to the (n+1)th line.

The coincidence detection circuits 216*a* and 216*b* operate alternately, and supply a signal-line driving voltage to the driver circuit 215 in accordance with the input GCP1 or GCP2. In other words, all the pixels for one line are displayed in such a manner that the pixels corresponding to SEG1 to SEG3 are displayed at bright gradation characteristics corresponding to GCP1, and the pixels corresponding to SEG4 to SEG6 are displayed at dark gradation characteristics corresponding to GCP2. In this manner, as shown as an example in FIG. 16(*c*), images such that patterns of a bright pixel and a dark pixel are different for each frame can be displayed.

In the first embodiment, a configuration for generating two GCPs can be provided inside a driver IC, and a display is performed by switching the GCPs by hardware control inside the driver IC. In comparison, in the second embodiment, based on input image data, images corresponding to two frames are provided by a software process, and a display is performed by switching these images. That is, in the first embodiment, the image data supplied to the driver IC is of one type, but in the second embodiment, two types of image data which is generated in a software manner are alternately supplied to the driver IC, and the driver IC simply displays the supplied image data.

Figure 18:
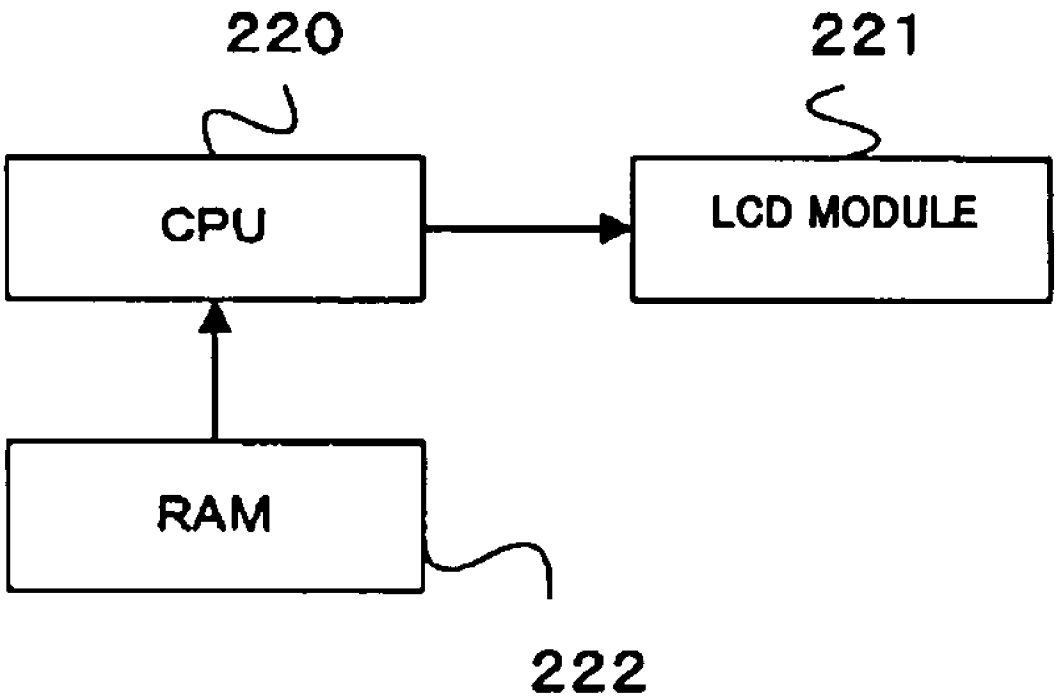
FIG. 18 shows an example of another configuration for frame switching control.

The overall configuration of the second embodiment is shown in FIG. 18. The input image data is temporarily stored in the RAM 222, and thereafter, it is sent to the CPU 220. Based on the input image data input from the RAM 222, the CPU 220 generates image data of two different patterns (for example, an image A and an image B), in which the light and dark of the gradation level is controlled, as shown as an example in FIG. 16(*c*). The image data of these two patterns corresponds to the n-th frame and the (n+1)th frame. Then, the CPU 220 alternately supplies the two pieces of image data to the LCD module 221. Here, the LCD module 221 is a unit including the liquid-crystal panel 101 and the driver IC, and displays the image data supplied from the CPU 220 on the liquid-crystal panel 101.

In this embodiment, since two types of image data are alternately input from the CPU 220, it becomes possible for the LCD module 221 to display an image different for each frame, as shown in FIG. 16, by simply displaying the image data. In other words, in this embodiment, since image data of two different patterns are generated by a software process, it is possible to use an ordinary LCD module, and thus the hardware configuration can be simplified.

A third embodiment is similar to the second embodiment in that mage data of two different patterns are generated by a software process, and is formed in such a manner that two RAMs for temporarily storing the generated images of two patterns can be provided to reduce the processing load on the CPU.

Figure 19:
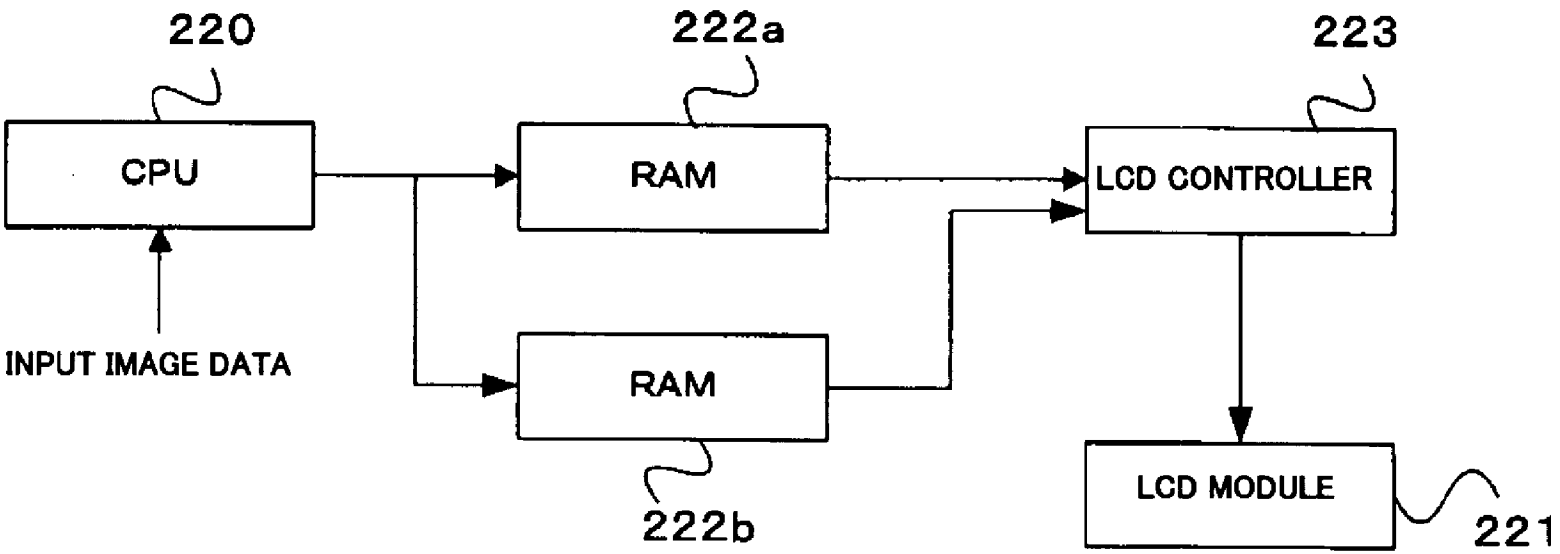
FIG. 19 shows an example of another configuration for frame switching control.

FIG. 19 schematically shows the configuration of an exemplary third embodiment. When the CPU 220 receives the input image data, the CPU 220 generates images of two different patterns and stores them in RAMs 222*a* and 222*b* correspondingly. The image data inside the RAM 222*a* and the RAM 222*b* is input to an LCD controller 223. The LCD controller 223 alternately selects the two pieces of image data for each frame and supplies it to the LCD module 221. Similarly to the second embodiment, the LCD module 221 displays the supplied image data on the liquid-crystal panel 101.

In the second embodiment, the load on the CPU increases and the power consumption also increases by an amount corresponding to that the CPU 220 transmits image data to the LCD module 221 each time for each frame. However, in the third embodiment, since two RAMs are provided, the load on the CPU is reduced correspondingly. Furthermore, since the image data of two different patterns are generated by a software process, it is possible to use an ordinary LCD module, and thus the hardware configuration can be simplified.

Figure 20:
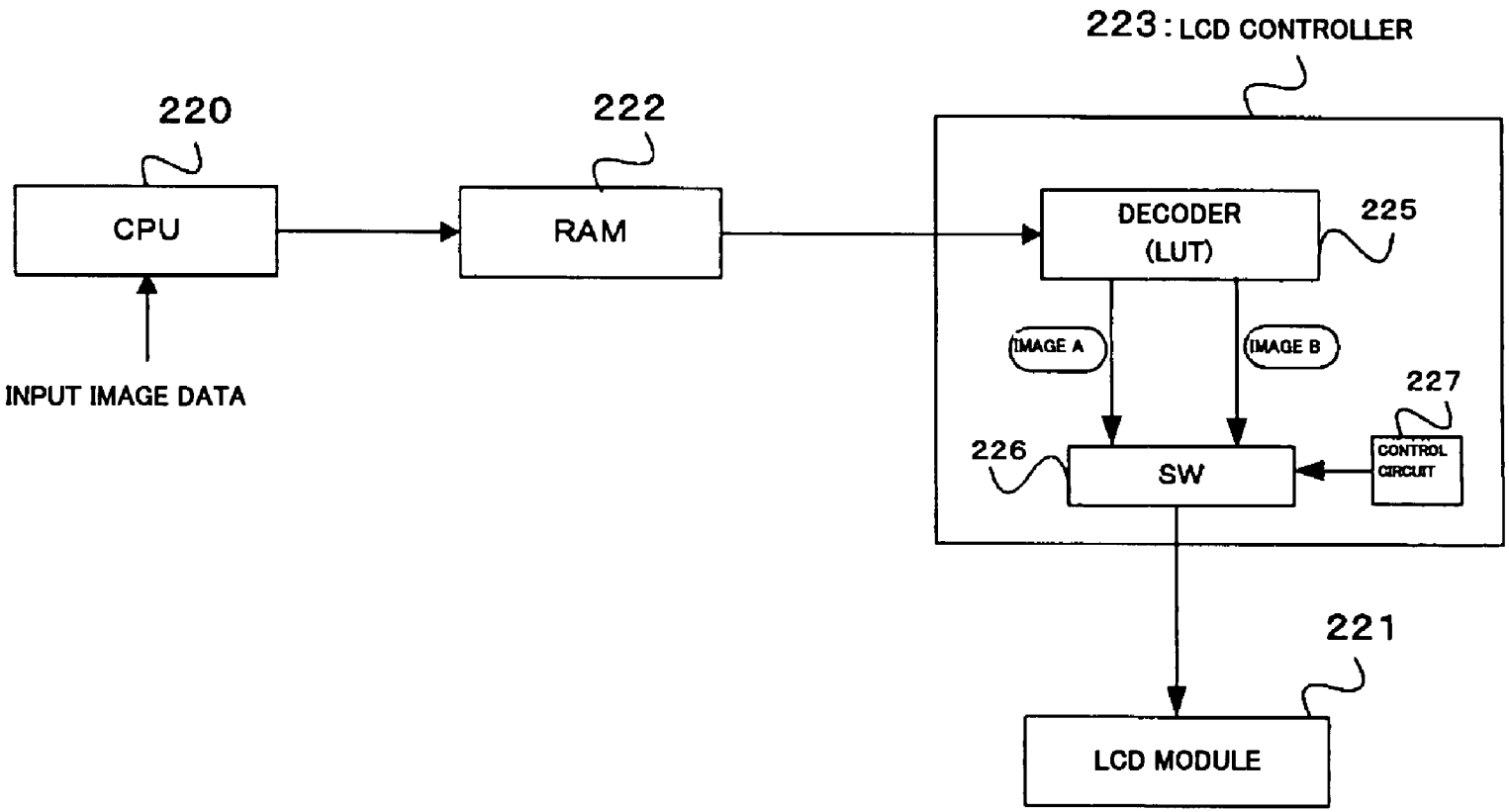
FIG. 20 shows an example of another configuration for frame switching control.

In a fourth embodiment, also, image data of two different patterns can be generated by a software process, and the processing is performed inside the LCD controller rather than by the CPU. FIG. 20 shows the configuration of the fourth embodiment. In FIG. 20, the LCD controller 223 includes a decoder 225, a switch 226, and a control circuit 227. The decoder 225 has, for example, LUTs (Look-Up Tables) of two different gradation characteristics.

The CPU 220 supplies the input image data to the RAM 222. After the RAM 222 temporarily stores it, the RAM 222 supplies the input image data to the decoder 225 inside the LCD controller 223. Referring to the LUTs of two different gradation characteristics, based on the input image data supplied from the RAM 222, the decoder 225 generates image data of two different patterns (an image A and an image B), and supplies it to the switch 226. The control circuit 227 supplies a switching instruction signal for each frame to the switch 226, and controls the switch 226 so that the image A and the image B, which are supplied from the decoder 225, are alternately selected, and this image is supplied to the LCD module 221. Similarly to the second and third embodiments, the LCD module displays the supplied image data on the liquid-crystal panel 101.

In this embodiment, since the CPU 220 does not need to generate image data, the load on the CPU can be reduced correspondingly. Furthermore, since image data of two different patterns is generated by a software process, an ordinary LCD module can be used, and thus the hardware configuration can be simplified.

In the gradation control for reducing crosstalk, as shown as an example in FIG. 16(*c*), the light and dark of the adjacent pixels can be controlled for each pixel. In contrast, instead of in units of pixels, the light and dark can also be controlled in units of subpixels (in units of RGB areas) which form the pixel. The technique thereof will now be described below.

Figure 21A:
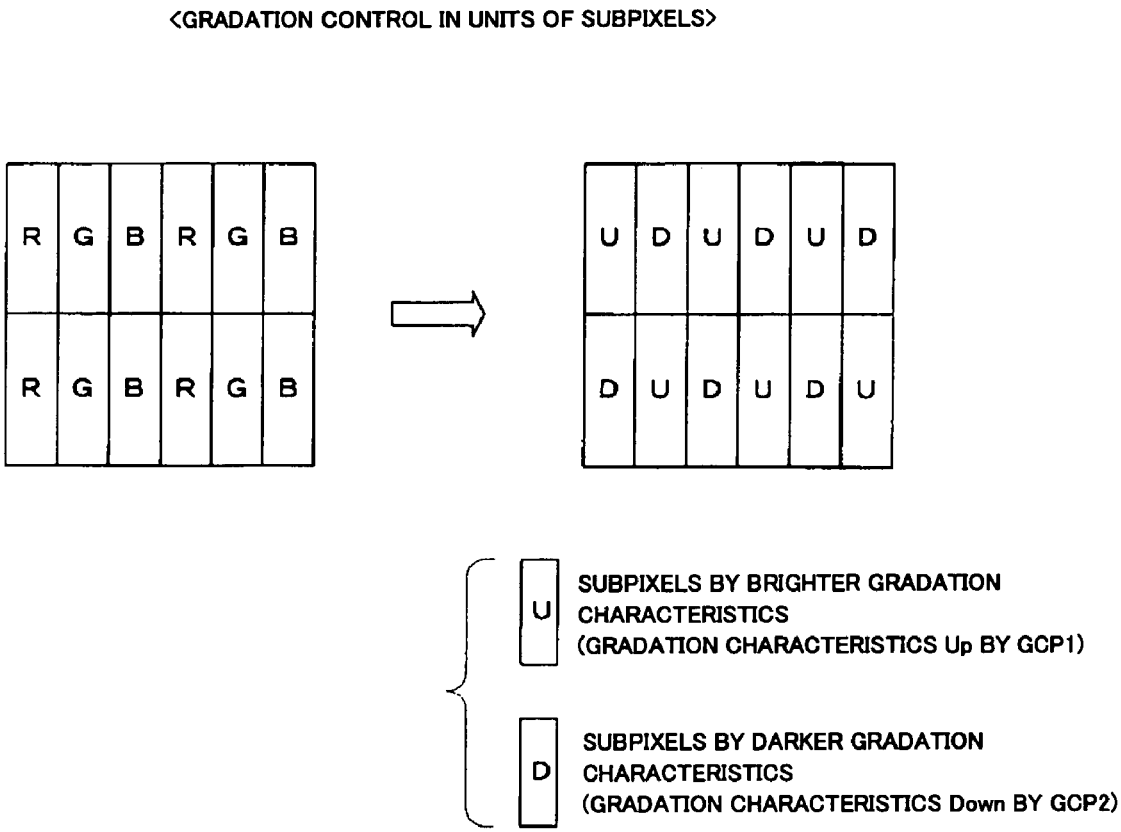
FIG. 21 illustrates gradation control in units of subpixels.
Figure 21B:
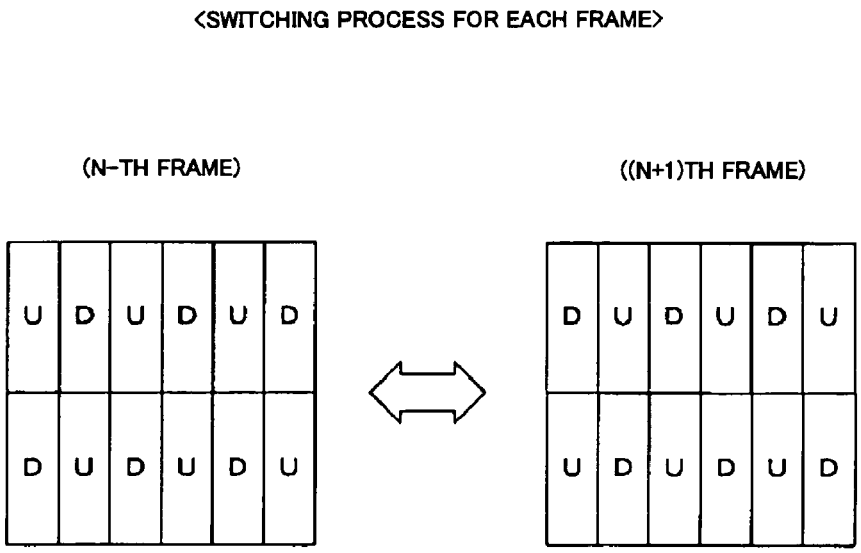

FIG. 21(*a*) shows an example for four pixels in which the light and dark is controlled in units of subpixels. In FIG. 21(*a*), the subpixels for the four pixels shown on the left side, which are arranged in a combination of light and dark in the upper and lower direction and in the left to right direction, are shown on the right side of FIG. 21(*a*). The subpixel indicated by "U" is displayed by bright gradation characteristics, and the subpixel indicated by "D" is displayed by dark gradation characteristics. In this manner, by forming the light and dark patterns in units of subpixels, the viewing angle improvement advantage is obtained more than in the case of pixel units.

A description will now be given of a case in which the frame switching control is applied to the case in which gradation control is performed in units of subpixels. When the frame switching control is applied to gradation control in units of subpixels shown in FIG. 21(*a*), as shown in FIG. 21(*b*), the light and dark patterns may be reversed between the n-th frame and the (n+1)th frame, and these patterns may be displayed by being switched for each frame. As a result, the advantage of preventing a decrease in the resolution by the frame switching control can be expected.

Figure 22A:
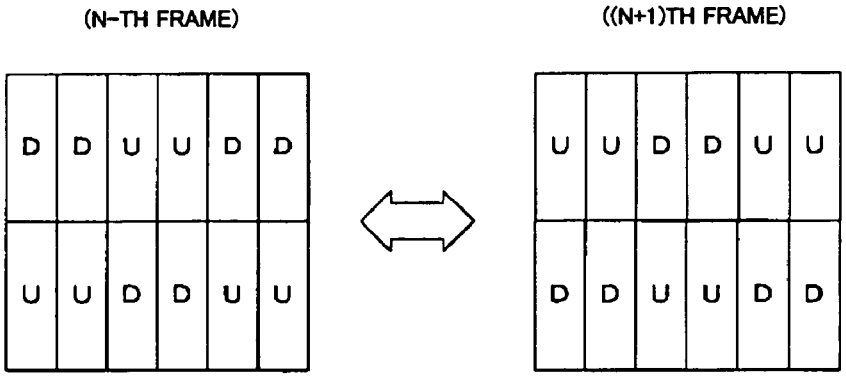
FIG. 22 shows an example of frame switching control in units of subpixels.
Figure 22B:
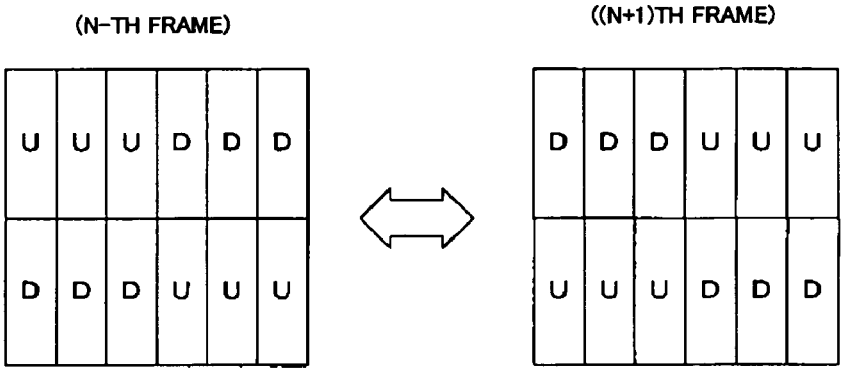
Figure 22C:
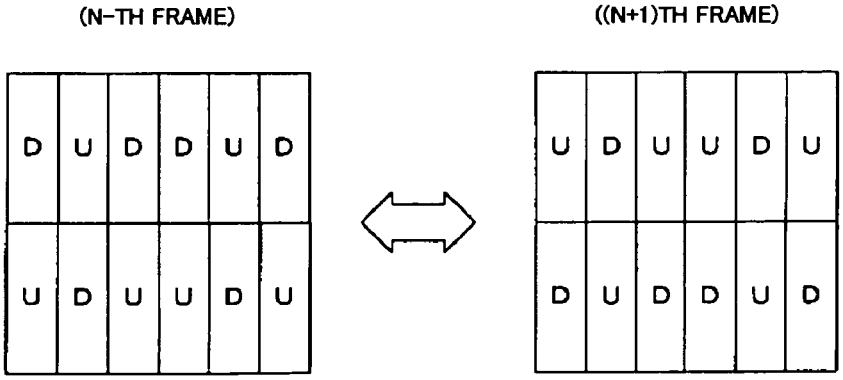

FIG. 22 shows another example of the case in which frame switching control is applied to gradation control in units of subpixels. FIG. 22(*a*) shows an example in which light and dark patterns are set for each of two subpixels which are adjacent in the horizontal direction. FIG. 22(*b*) shows an example in which light and dark patterns are set for each of three subpixels which are adjacent in the horizontal direction. FIG. 22(*c*) shows an example in which light and dark patterns are set for two groups of green (G) and the combination of R (red) and B (blue) by considering the fact that the luminosity of a human being for green (G) is high among the three RGB colors.

In the control for switching frame images described above, as shown in FIGS. 16, 21, and 22, a decrease in the resolution is reduced by alternately displaying a different image pattern for each frame, that is, by switching and displaying a different image pattern with two frames being one period (one unit). In contrast, as described below, a different image pattern can be switched and displayed at an odd-numbered frame period, more preferably, with three frames being one period.

Figure 23A:
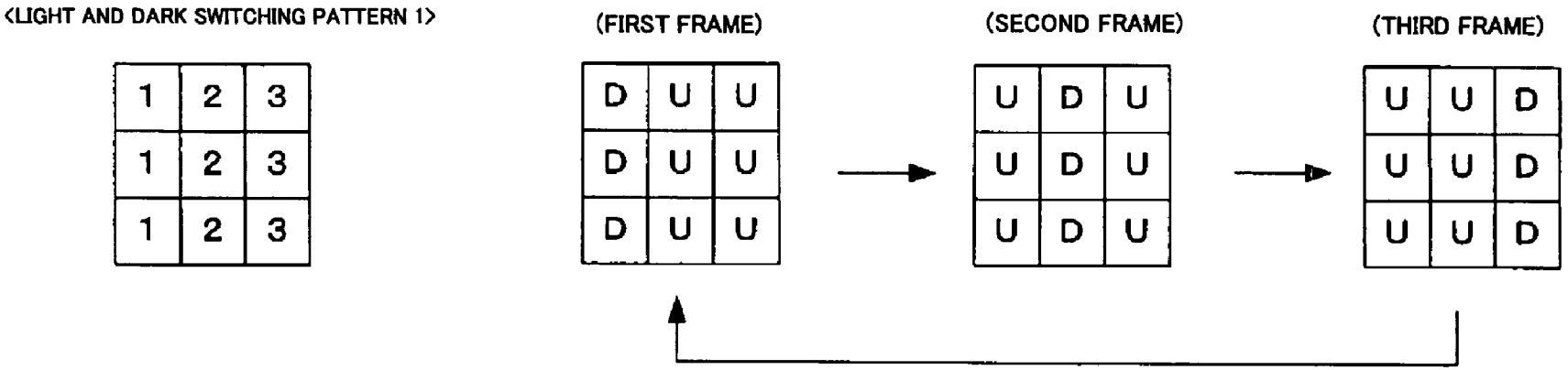
FIG. 23 shows an example of an image pattern for frame switching control in which three frames are used as one period.
Figure 23B:
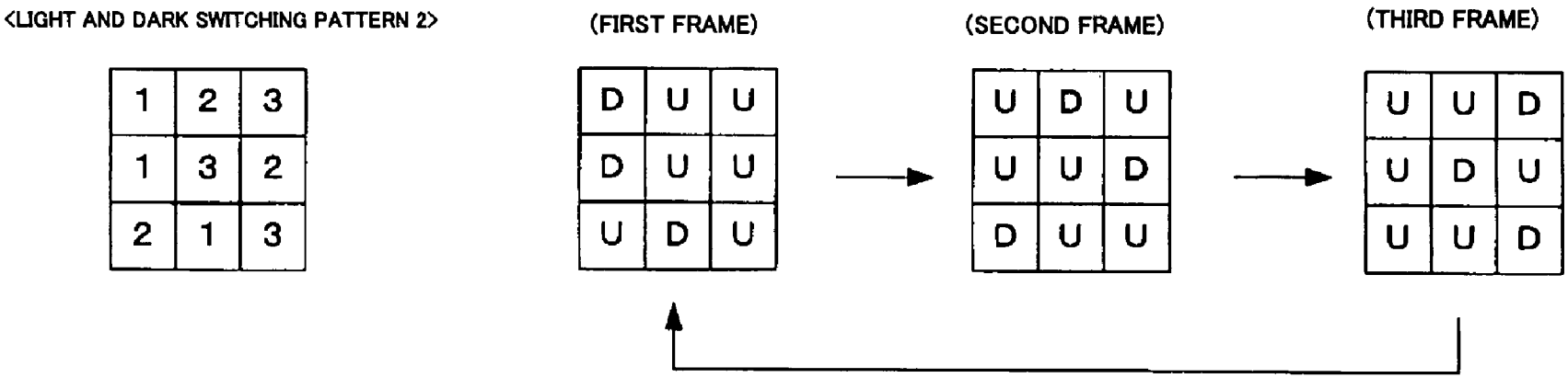

FIG. 23(*a*) shows an example in which a different image pattern is switched and displayed with three frames being one period. On the left side of FIG. 23(*a*), a light and dark switching pattern example 1 is shown. The light and dark switching pattern example 1 shows how the light and dark of each pixel in a block of 3×3 pixels (length and width) change in three continuous frames. The numerical value ("1" to "3") indicated in each pixel portion of the light and dark switching pattern example 1 indicates the frame number at which the pixel is displayed as the above-mentioned dark pixel (that is, the pixel displayed in accordance with the dark gradation characteristics). For example, the pixel at which the numerical value "1" is written is displayed as a dark pixel in the first frame when three frames are used as one period, and the pixel at which the numerical value "2" is written is displayed as a dark pixel in the second frame when three frames are used as one period.

Based on the light and dark switching pattern example 1, the change in the light and dark of each pixel of the frame image of one period formed of three frames, is shown on the right side of FIG. 23(*a*). Here, similarly to FIG. 21, the pixel at which "D" is written in the figure is a dark pixel (the pixel displayed by darker gradation characteristics), and the pixel at which "U" is written is a bright pixel (the pixel displayed by brighter gradation characteristics). As is understood from a reference to the light and dark switching pattern example 1, in the first frame, three pixels of one column on the left side are displayed as dark pixels, and the remaining pixels are displayed as bright pixels. In the second frame, the three pixels in the center column are displayed as dark pixels, and the remaining pixels are displayed as bright pixels.

In the third frame, three pixels of one column on the right side are displayed as dark pixels, and the remaining pixels are displayed as bright pixels.

Another light and dark switching pattern example 2 is shown in FIG. 23(*b*). In the light and dark switching pattern example shown in FIG. 23(*a*), since the same gradation value is continuous in a straight line (in the vertical direction), jitter is likely to occur. However, in the light and dark switching pattern example 2 shown in FIG. 23(*b*), jitter is not likely to occur. The pixels from the first frame to the third frame, which are generated in accordance with the light and dark switching pattern example 2, are shown on the right side of FIG. 23(*b*). As is understood from a reference to the light and dark switching pattern example 2, in the first frame, the pixels at which the numerical value "1" is written in the light and dark switching pattern example 2 are displayed as dark pixels, and the remaining pixels are displayed as bright pixels. In the second frame, the pixels at which the numerical value "2" is written in the light and dark switching pattern example 2 are displayed as dark pixels, and the remaining pixels are displayed as bright pixels. In the third frame, the pixel at which the numerical value "3" is written in the light and dark switching pattern example 2 are displayed as dark pixels, and the remaining pixels are displayed as bright pixels.

Also, in a case where frame switching control is performed by using three frames as one period in the manner described above, the above-mentioned decrease in the resolution can be reduced similarly to the case where frame switching control is performed by using two frames as one period, as shown in FIG. 16. Furthermore, in a case where frame switching control is performed by using an odd number of frames, such as three frames, as one period, when compared to the case in which frame switching control is performed by using an even number of frames, such as two frames or four frames, as one period, there is the advantage that direct current (DC) components in a pixel driving waveform can be removed. This will now be described below.

Figure 24A:
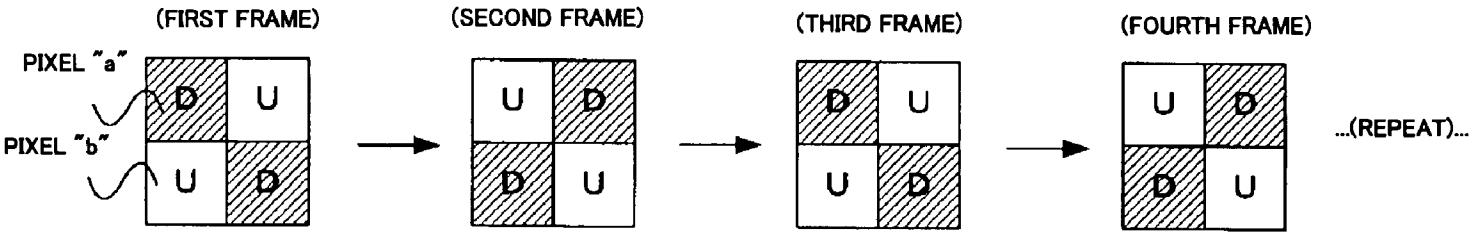
FIG. 24 shows an example of frame switching control in which two frames are used as one period.
Figure 24B:
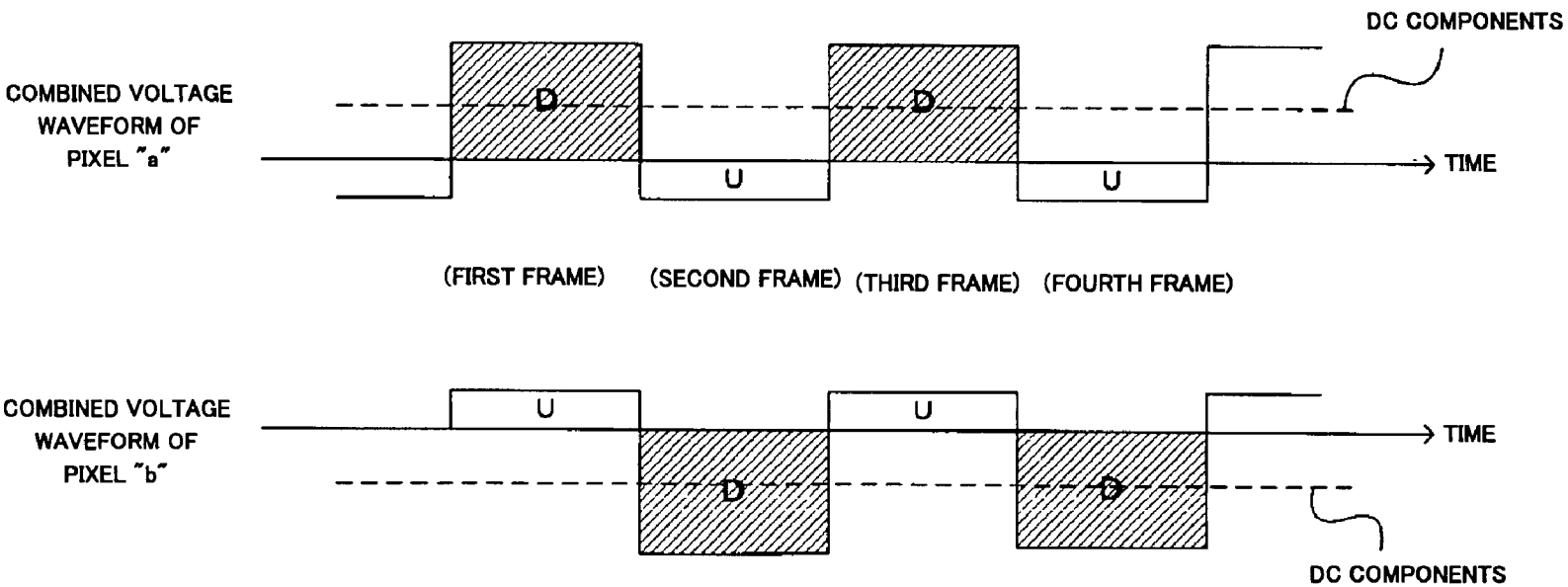

FIG. 24(*a*) shows an example of the light and dark of pixels when frame switching control is performed by using two frames as one period (that is, when the image patterns are alternately switched for each frame), as shown in FIG. 16. In this example, since frame switching control is performed by using two frames as one period, the image pattern of the first frame and the image pattern of the second frame are alternately displayed also in the subsequent third, fourth, and following frames thereafter.

FIG. 24(*b*) shows a combined voltage waveform applied to pixels "a" and "b" in FIG. 24(*a*). For example, the pixel "a" in the first frame becomes a dark pixel, the pixel "a" in the second frame becomes a bright pixel, and the pixel "a" in the third frame becomes a dark pixel, and the pixel "a" in the fourth frame becomes a bright pixel.

If it is assumed that the liquid-crystal display device is in a normally white mode, the level of the combined voltage waveform of the dark pixel is high (indicated by "D"), and the level of the combined voltage waveform of the bright pixel is low (indicated by "U"). As described above, in the liquid-crystal display device, since the polarity of the driving voltage is reversed for each frame, the combined voltage waveform applied to the pixels "a" and "b" is as shown in FIG. 23(*b*). Therefore, each combined voltage waveform has DC voltage components, and this can result in burn-in of the liquid crystal.

Figure 25A:
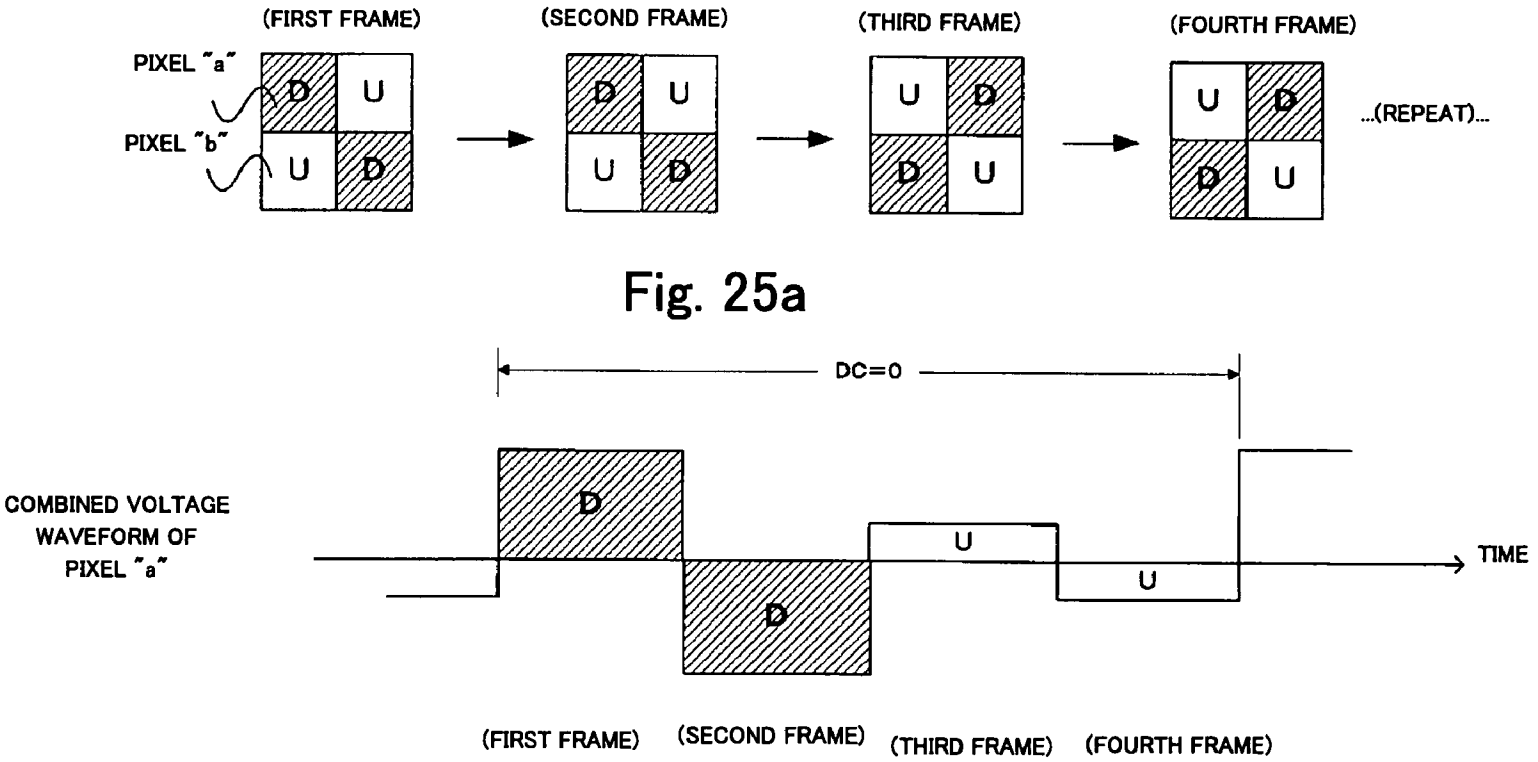
FIG. 25 shows an example of frame switching control in which four frames are used as one period.
Figure 25B:
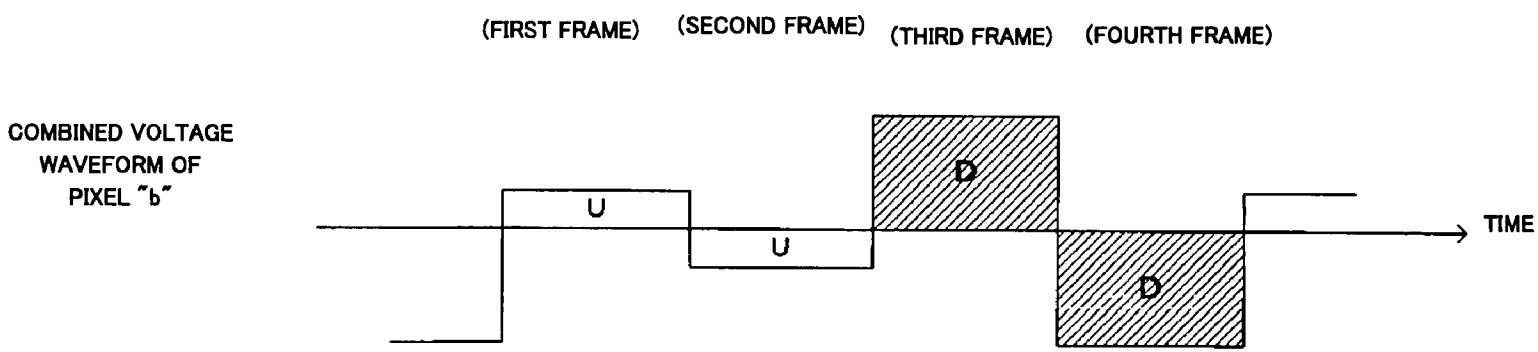

FIG. 25 shows an example in which frame switching control is performed by using four frames as one period. FIG. 25(*a*) shows the light and dark of each pixel of the first to fourth frames in that case. In this example, the first frame and the second frame have the same image pattern, and the third frame and the fourth frame have the same image pattern. Furthermore, FIG. 25(*b*) shows a combined voltage waveform applied to the pixels "a" and "b". As is understood from FIG. 25(*b*), in this example, the DC components applied to each pixel are cancelled in units of four frames. Therefore, when compared to the frame switching control example in which two frames are used as one period, the occurrence of the defect of the burn-in of the liquid crystal due to the DC components can be prevented. However, in this example, since the same image pattern is repeated in units of two frames, there is the problem of flicker being conspicuous in the display image.

Figure 26A:
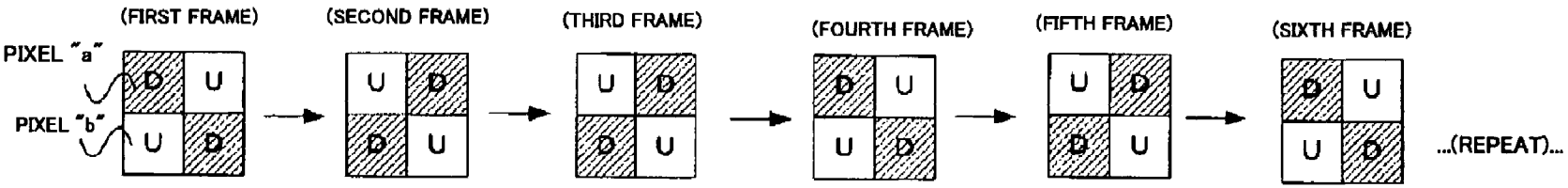
FIG. 26 shows an example of frame switching control in which three frames are used as one period.
Figure 26B:
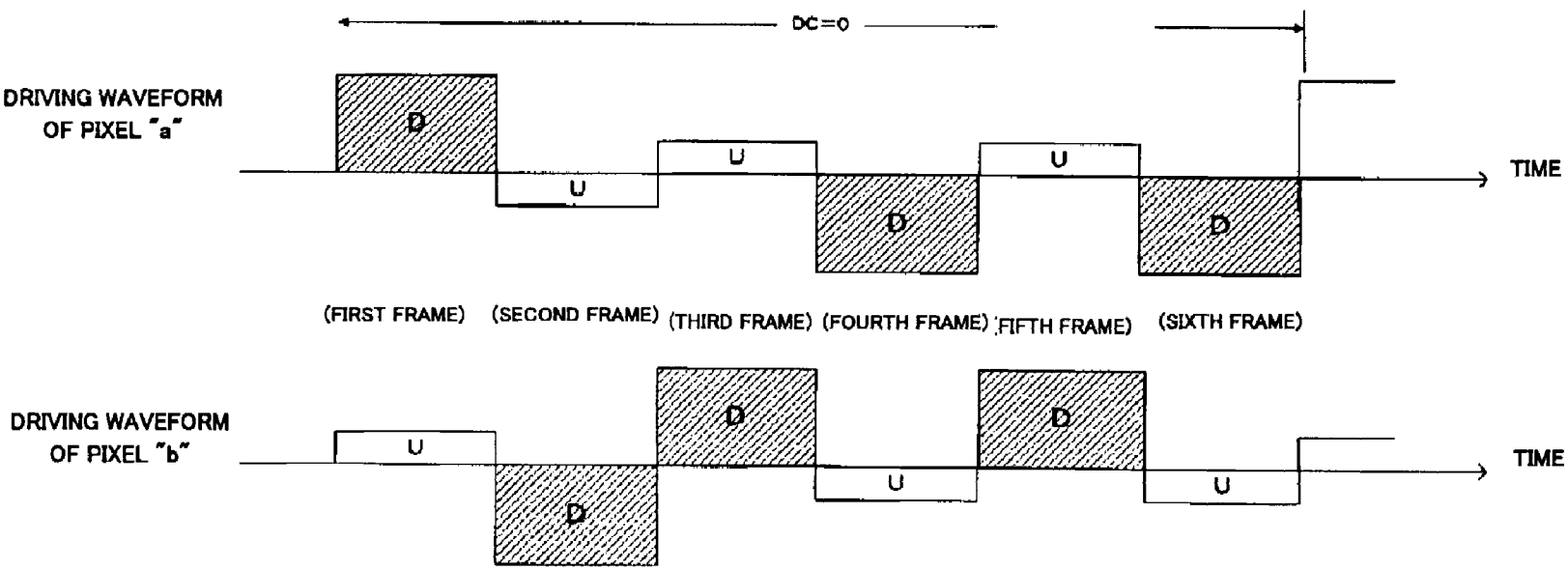

FIG. 26 shows an example in which frame switching control is performed by using three frames as one period. FIG. 26(*a*) shows the light and dark of each pixel of the first to sixth frames in that case. The first to third frames constitute one period, and the fourth to sixth constitute one period. FIG. 26(*b*) shows a combined voltage waveform applied to the pixels "a" and "b". As is understood from FIG. 26(*b*), in this example, the DC components applied to each pixel are cancelled in units of six frames. Therefore, when compared to the frame switching control example in which two frames are used as one unit, shown in FIG. 24, the occurrence of the problem of the burn-in of the liquid crystal due to the DC components can be prevented. Furthermore, since an image pattern is not repeated every two frames as in the example of FIG. 25, the problem of the flicker being conspicuous in the display image can also be prevented.

As a result of the above, by performing frame switching control in which three frames are used as one period, the problem of DC components being applied to the liquid crystal and the problem of the occurrence of flicker do not occur, and thus a decrease in the resolution can be prevented.

A description will now be given of a method of determining the gradation value of each pixel in a case where frame switching control is performed by using three frames as one period. As described with reference to FIG. 16, when frame switching control is performed by using two frames as one period, a pixel having a particular gradation value, at which it should originally be displayed, is displayed in such a manner that a pixel brighter than that and a pixel darker than that are combined. Therefore, in the simplest method, as described above, the gradation values in two frames may be determined so that the average of the gradation values of a bright pixel and a dark pixel becomes the gradation value of the pixel to be displayed.

In comparison, when frame switching control is performed by using three frames as one period, the pixel to be displayed is displayed two times as either a dark pixel or a bright pixel within three frames which form one period and is displayed as the other one time. In other words, of the three frames, the pixel is displayed as dark pixels two times and as a bright pixel one time, or is displayed as a dark pixel one time and as a bright pixel two times. If it is assumed that the gradation value of the pixel which should originally be displayed is denoted as x and the pixel is displayed by two dark pixels having a gradation value xd and one bright pixel having a gradation value xb, the gradation values xd and xb need to be determined so that the average of the gradation values of the total of the three pixels become close to the gradation value of the pixel which should originally be displayed. In the simplest example, $$x=(2\times xd+1\times xb)/3.$$

In the case of the normally white display, since the pixel capacitance in the case of displaying a dark pixel is greater, the degree of the occurrence of noise in dark pixels becomes greater than that in bright pixels. Therefore, if the gradation values of dark pixels and bright pixels are determined so that the appearance frequency of the dark pixel is low and the appearance frequency of the bright pixel is high, the influence of noise can be reduced. Furthermore, when there is a situation in which the setting of the pulse width of the GCP corresponding to each gradation value becomes easy by setting the gradation values of the corresponding bright pixel and dark pixel to specific values in order to display the gradation of the pixel which should originally be displayed, it is preferable that each gradation value be determined in accordance with that situation.

In the above-described example, an example in which frame switching control is performed by using three frames as one period is shown. Alternatively, by performing frame switching control by using an odd number of frames, such as five frame or seven frames, similarly, the problem of the application of DC components or the problem of flicker do not occur, and thus a decrease in the resolution can be reduced. For example, when frame switching control is performed by using five frames as one period, a particular pixel is displayed as either a dark pixel or a bright pixel in three frames among the five frames and is displayed as the other in the remaining two frames, and thus the problem of flicker does not occur. In the case where five frames are used as one period, the DC components of the combined voltage waveform applied to the pixel are cancelled every ten frames.

As described above, by displaying a pixel to be displayed as a plurality of pixels having different gradation values, crosstalk can be reduced, and also the viewing angle improvement advantage can be obtained. However, in that case, the resolution is decreased by an amount corresponding to that one pixel is displayed by a combination of a plurality of pixels. On the other hand, in order to suppress a decrease in resolution, it is preferable that a frame switching process be performed, but if the frame switching process is applied, the viewing angle improvement advantage cannot be expected. That is, in a case where the technique is adopted in which, in order to reduce crosstalk, a pixel to be displayed is displayed as a plurality of pixels having different gradation values, the viewing angle improvement and the prevention of the reduction in resolution can be realized only selectively.

As a result, in, for example, electronic devices to which the image display apparatus of the invention is applied, the construction may be formed in such a way that a user can specify as to which one of the above should be taken with priority by input device, etc. For example, in an electronic device such as a mobile phone or a PDA, the construction is formed in such a way that the user can specify a wide viewing-angle priority mode or a resolution priority mode as a display mode by operating input keys, etc. Then, if the frame switching control is not applied in the case of the wide viewing-angle priority mode and if the frame switching control is applied in the case of the resolution priority mode, it becomes possible for the user to perform an appropriate image display in the mode preferred by the user according to the type of image to be displayed.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An image display apparatus, comprising:

a display section; and a display control device that displays, on said display section, a plurality of input pixels which form input image data in such a manner that a plurality of display pixels having gradation values differing from gradation values of the input pixels are combined, said input image data being formed of a plurality of frame images, said display control device further comprising a switching control device that switches and displays, for each of the frame images, a first combination of said plurality of display pixels and a second combination of said plurality of display pixels, which differ from each other, the first combination of said plurality of display pixels being formed in such a manner that display pixels whose gradation values are greater than those of said input pixels and display pixels whose gradation values are less than those of said input pixels are alternately arranged in a direction of the scanning lines of said display section, and the second combination of said plurality of display pixels being formed in such a manner that display pixels whose gradation values are greater than those of said input pixels and display pixels whose gradation values are less than those of said input pixels are alternately arranged in sequences, reverse to the first combination of said plurality of display pixels in the direction of the scanning lines of said display section.

2. The image display apparatus according to claim 1, said display control device further including a driving device that drives a pixel area of said display section on the basis of a driving pulse signal specified by the number of gradation control pulses corresponding to the gradation values of the display pixels, and said switching control device displaying the first combination of said plurality of display pixels and the second combination of said plurality of display pixels by controlling said gradation control pulses.

3. The image display apparatus according to claim 1, said switching control device further including a device that generates the first combination of said plurality of display pixels and the second combination of said plurality of display pixels on a basis of said input image data.

* * * * *